US011267024B2

(12) United States Patent
Innes

(10) Patent No.: US 11,267,024 B2
(45) Date of Patent: Mar. 8, 2022

(54) PROGRAMMABLE TANK CLEANING NOZZLE

(71) Applicant: AGI Engineering, Inc., Stockton, CA (US)

(72) Inventor: Alexander G. Innes, Lodi, CA (US)

(73) Assignee: AGI Engineering, Inc., Stockton, CA (US)

( * ) Notice: Subject to any disclaimer, the term of this patent is extended or adjusted under 35 U.S.C. 154(b) by 92 days.

(21) Appl. No.: 16/725,575

(22) Filed: Dec. 23, 2019

(65) Prior Publication Data

US 2020/0130029 A1 Apr. 30, 2020

Related U.S. Application Data

(63) Continuation-in-part of application No. 16/437,796, filed on Jun. 11, 2019.

(Continued)

(51) Int. Cl.

*B08B 9/049* (2006.01)
*B08B 9/043* (2006.01)

(Continued)

(52) U.S. Cl.

CPC ..... *B08B 9/0495* (2013.01); *B08B 9/0433* (2013.01); *B05B 1/14* (2013.01);

(Continued)

(58) Field of Classification Search

CPC ..... B08B 9/0495; B08B 9/0433; B08B 2209/045; B05B 1/14; B05B 3/06; E03F 9/005

(Continued)

(56) References Cited

U.S. PATENT DOCUMENTS 1,611,326 A 12/1926 Abbe
2,461,433 A 2/1949 Moulton (Continued)

FOREIGN PATENT DOCUMENTS

EP 1166903 1/2002
IN 201741036558 10/2017

(Continued)

OTHER PUBLICATIONS

Pearson, M.J., et al., "Biomimetic Vibrissal Sensing for Robots," Philosophical Transactions of the Royal Society B (2011), vol. 366, pp. 3085-3096, 12 pages.

(Continued)

*Primary Examiner* — Tinsae B Ayalew
(74) *Attorney, Agent, or Firm* — Brian S. Steinberger; Hilary F. Steinberger; Law Offices of Brian S. Steinberger, P.A.

(57) ABSTRACT

Manual, automated, or semi-automated programmable tank cleaning nozzle systems, devices and methods for providing safe and efficient methods for breaking up oil, tar, chemical, radioactive, hazardous, or any other liquid, solid, or sludge waste inside storage tanks, ballast tanks, floating roof tanks, void tanks, rail tank cars and the like with nozzles which utilize fluid jets to break up, liquefy, and motivate tank material. The programmable tank cleaning nozzle incorporates two degrees of freedom and can be mounted to existing booms, robotic arms, gantry systems, rigid beams, manways, or any other rigid structure. The programmable tank cleaning nozzle can be a standalone, independent unit or integrated into new designs and/or existing systems. Simplified programming and user interface allowing an operator to remotely operate the system without the need for a camera system. The system is hydraulically controlled and can work in the presence of flammable vapors and dust.

21 Claims, 19 Drawing Sheets

Related U.S. Application Data

(60) Provisional application No. 62/784,512, filed on Dec. 23, 2018, provisional application No. 62/683,215, filed on Jun. 11, 2018.

(51) Int. Cl.
*B05B 1/14* (2006.01)
*E03F 9/00* (2006.01)
*B05B 3/06* (2006.01)

(52) U.S. Cl.
CPC ..... *B05B 3/06* (2013.01); *B08B 2209/045* (2013.01); *E03F 9/005* (2013.01)

(58) Field of Classification Search
USPC ..... 134/167 c
See application file for complete search history.

(56) References Cited

U.S. PATENT DOCUMENTS 2,611,523 A 9/1952 Aines
2,668,625 A 2/1954 Garland
2,669,941 A 2/1954 Stafford
2,682,886 A 7/1954 Paxton
2,761,297 A 9/1956 Buchsteiner
2,819,803 A 1/1958 Obenchain
2,833,422 A 5/1958 Ferwerda
2,985,192 A 5/1961 Taylor
2,999,600 A 9/1961 Gates
3,060,972 A 10/1962 Sheldon
3,095,044 A 6/1963 Medlock
3,116,021 A 12/1963 Bom
3,155,048 A 11/1964 Mandelbaum
3,161,490 A 12/1964 Dudek
3,162,214 A 12/1964 Bazinet, Jr.
3,190,286 A 6/1965 Stokes
3,266,059 A 8/1966 Stelle
3,274,850 A 9/1966 Tascio
3,305,220 A 2/1967 Nevulis
3,469,712 A 9/1969 Haulotte
3,497,083 A 2/1970 Anderson
3,580,099 A 5/1971 Mosher
3,599,871 A 8/1971 Ruppel
3,757,697 A 9/1973 Phinney
3,788,338 A 1/1974 Burns
3,845,596 A 11/1974 Veenstra
3,863,844 A 2/1975 McMillan
3,889,618 A 6/1975 Jarvis et al.
3,932,065 A 1/1976 Ginsberg et al.
3,951,572 A 4/1976 Ray, Jr. et al.
4,106,671 A 8/1978 Sharples
4,132,041 A 1/1979 Van den Broek
4,156,331 A 5/1979 Lester
4,250,933 A 2/1981 Olson
4,339,232 A 7/1982 Campbell
4,396,728 A 7/1983 Larson et al.
4,396,093 A 8/1983 Zimmerman
4,415,297 A 11/1983 Boring
4,494,417 A 1/1985 Larson et al.
4,540,869 A 9/1985 Yasuoka
4,630,741 A 12/1986 Stevens
4,661,039 A 4/1987 Brenholt
4,685,349 A 8/1987 Wada et al.
4,817,653 A 4/1989 Krajicek et al.
4,828,461 A 5/1989 Laempe
4,848,179 A 7/1989 Ubhayakar
4,944,535 A 7/1990 Maupin
4,945,955 A 8/1990 Murphy
4,977,790 A 12/1990 Nishi et al.
5,007,803 A 4/1991 DiVito et al.
D326,336 S 5/1992 Christ
5,172,710 A 12/1992 Harrington
5,174,168 A 12/1992 Takagi et al.
5,297,443 A 3/1994 Wentz
5,439,020 A 8/1995 Lockhart
5,451,135 A 9/1995 Schempf et al.
5,515,654 A 5/1996 Anderson
5,518,553 A 5/1996 Moulder
5,540,172 A 7/1996 Goldbach et al.
5,607,000 A 3/1997 Cripe et al.
5,715,852 A 2/1998 Jepsen
5,740,821 A 4/1998 Arnold
5,913,320 A 6/1999 Varrin, Jr. et al.
6,193,169 B1 * 2/2001 Steinhilber ..... B05B 3/003 239/240
6,213,135 B1 4/2001 Moulder
6,264,434 B1 7/2001 Frank
6,273,790 B1 8/2001 Neese et al.
6,280,408 B1 8/2001 Sipin
6,561,368 B1 5/2003 Sturm, Jr. et al.
6,651,837 B2 11/2003 Stradinger et al.
6,830,079 B1 12/2004 Ahrens et al.
6,889,920 B2 5/2005 Nance et al.
6,938,691 B2 9/2005 Face
7,021,675 B2 4/2006 Lawson
7,032,628 B2 4/2006 Guillemette et al.
7,100,631 B2 9/2006 Liu et al.
7,241,080 B2 7/2007 Klobucar et al.
7,708,504 B2 5/2010 Heckendorn et al.
7,998,251 B2 8/2011 Pondelick et al.
8,069,747 B2 12/2011 Buckingham et al.
8,205,522 B2 6/2012 Buckingham et al.
8,347,563 B2 1/2013 Anderson
8,414,246 B2 4/2013 Tobey
8,702,399 B2 4/2014 Krohn
8,727,671 B2 5/2014 Sundholm
8,763,855 B1 7/2014 Harvey et al.
8,840,087 B2 9/2014 Guyard
9,195,238 B2 11/2015 Roden et al.
10,280,063 B2 5/2019 Innes et al.
10,406,571 B2 9/2019 Innes et al.
2002/0002426 A1 1/2002 Burkhard
2005/0025573 A1 2/2005 Waldman et al.
2005/0109376 A1 5/2005 Gregory
2005/0166413 A1 8/2005 Crampton
2006/0054189 A1 * 3/2006 Luke ..... B08B 9/08 134/22.1
2006/0054202 A1 3/2006 Luke et al.
2008/0148876 A1 6/2008 Hock et al.
2010/0221125 A1 9/2010 Fulkerson et al.
2010/0234988 A1 9/2010 Buckingham et al.
2010/0264013 A1 10/2010 Burton
2011/0036381 A1 * 2/2011 Zilai ..... B05B 13/0636 134/168 R
2011/0186657 A1 8/2011 Haviland
2011/0315165 A1 12/2011 McWhorter
2012/0106882 A1 5/2012 Ponnouradjou et al.
2012/0279537 A1 11/2012 Peeters et al.
2014/0079573 A1 3/2014 Pabst
2015/0034176 A1 2/2015 Arguelles et al.
2015/0036200 A1 2/2015 Matsushita et al.
2015/0124242 A1 5/2015 Pierce et al.
2016/0055268 A1 2/2016 Bell et al.
2016/0107207 A1 4/2016 DesOrmeaux
2017/0173617 A1 6/2017 Zilai et al.
2017/0259309 A1 9/2017 Innes et al.

FOREIGN PATENT DOCUMENTS

JP 2004301665 10/2004
WO 2009018599 2/2009
WO 2014019852 2/2014

OTHER PUBLICATIONS

Innes, Alex. G., PCT Patent Application No. PCT/US/19/068359, filed Dec. 23, 2019, Notification of Transmittal of the International Search Report and the Written Opinion of the International Search Authority, or the Declaration dated Feb. 25, 2020, 14 pages.
OCEANEERING International, Inc., PCT Patent Application No. PCT/US18/060093, filed Nov. 9, 2018, Notification of Transmittal of the International Search Report and The Written Opinion of the

(56) References Cited

OTHER PUBLICATIONS

International Searching Authority, or the Declaration dated Feb. 5, 2019, 3 pages.
Innes, Alex. G., PCT Patent Application No. PCT/US/19/036567, filed Jun. 11, 2019, Notification of Transmittal of the International Search Report and the Written Opinion of the International Search Authority, or the Declaration dated Sep. 17, 2019, 7 pages.
Lane, et al. "FY10 Engineering Innovations, Research and Technology Report" In: Lawrence Livermore National Lab. Jan. 31, 2011 (Jan. 3, 2011) retrieved on Aug. 10, 2019 (Aug. 8, 2019) from https://e-reports-ext.llnl.gov/pdf/461932.pdf, 99 pages.
Bullseye Pumps, Bullseye B200-SPDK Vacuum Loading Solids Pump, 2017, retrieved from http://www.bullseyepumps.com/products/bullseye-b200-spdk-vacuum-loading-sotids-pump?variant=31478670788, 10 pages.
Sykes Pumps, General Purpose, GP50 Pump Performance, 2017, retrieved from http://www.sykespumps.com.sa/pumps/product-specs/gp_50_75.html, 2 pages.
Pentair Southern Cross, SX60 Portable Slurry Pump, 2017, retrieved from http://southerncross.pentair.com.au/product/market/pumps/vacuum-pumps/sx60-portable-slurry-pump/, 3 pages.
Wastecorp, Pumps, Super Duty, TVP-65 Series Vacuum Pumps, 2017, brochure, 1 page.
Innes, et al., PCT Patent Application No. PCT/US2017/018120 filed Feb. 16, 2017, Notification Concerning Transmittal International Preliminary Report on Patentability, 12 pages.
Ritchiespecs, Gradall 534D-9-45 Telescopic Forklift, 2017, retrieved from www.ritchiespecs.com, 2 pages.
Boom, Gradall Material Handler 534 D-6534 D-6 Turbo, Jul. 2002, 1 page.
Manitowoc, National Crane 600H Series Product Guide, 2012, 16 pages.
Manitowoc, National Crane 680H-TM, Aug. 2015, 4 pages.
Festo, Bionic Handling Assistant, Apr. 2012, 6 pages.
Schutz, Maxon Motor, Robotic Snake-Arm Flies Right Into Tight Spaces, 2012, 4 pages.
McMahan, W., et al., Field Trials and Testing of the OctArm Continuum Manipulator, IEEE, May 2006, pp. 2336-2341, 6 pages.
Li, Z., et al., A Novel Tele-Operated Flexible Robot Target for Minimally Invasive Robotic Surgery, Engineering Research Robotics Article, Mar. 2015, pp. 073-078, vol. 1, Issue 1, 6 pages.
Li, Z., et al., Kinematic Comparison of Surgical Tendon-Driven Manipulators and Concentric Tube Manipulators, Mechanism and Machine Theory, 2017, pp. 148-165, vol. 7, 18 pages.
Military Elevation Solutions and Tactical Trailers, KVL and KVR Telescopic Cable-Drive Masts, Sep. 2016, 3 pages.
OCRobotics, Laser Snake 2, Snake-arm robot and high-power laser integration, www.ocrobotics.com, 2016, 4 pages.
OCRobotics, Nuclear decommissioning case-study. Laser Snake, Snake-arm robot and high-power laser integration, www.ocrobotics.com, 2016, 4 pages.
Bauer, et al., Development and Deployment of the Extended Reach Sluicing System (ERSS) for Retrieval of Hanford Single Shell Tank Waste—14206 (Draft), U.S. Deparlment of Energy, Assistant Secretary for Environmental Management, Washington River Protection Solutions, Nov. 2013, 19 pages.
Innes, et al., PCT Patent Application No. PCT/US2017/018120 filed Feb. 16, 2017, Notification of the Transmittal of the International Search Report and the Written Opinion of the International Searching Authority, or the Declaration dated May 10, 2017, 14 pages.
Innes, A., PCT Patent Application No. PCT/US2019/036567 filed Jun. 11, 2019, International Search Report dated Sep. 17, 2019, 2 pages.

* cited by examiner

PROGRAMMABLE TANK CLEANING NOZZLE

RELATED APPLICATIONS

This application claims the benefit of priority to U.S. Patent Application Ser. No. 62/784,512 filed Dec. 23, 2018, and this application is a Continuation-In-Part of U.S. patent application Ser. No. 16/437,796 filed Jun. 11, 2019, which claims the benefit of priority to U.S. Provisional Patent Application Ser. No. 62/784,512 filed Dec. 23, 2018 and U.S. Provisional Patent Application Ser. No. 62/683,215 filed Jun. 11, 2018. The entire disclosure of each of the applications listed in this paragraph are incorporated herein by specific reference thereto.

FIELD OF INVENTION

This invention relates to breaking up oil and tar, or any other chemical, radioactive, or hazardous liquid, solid, or sludge waste from inside oil field tanks, ballast tanks, void tanks, floating roof tanks, rail tank cars and the like, and more specifically, this invention relates to manual, automated, or semi-automated, tank cleaning systems, devices, and methods for breaking up oil and tar, or any other chemical, radioactive or hazardous liquid, solid, or sludge waste from inside storage oil field tanks, ballast tanks, void tanks, floating roof tanks, rail tank cars and the like with nozzles which utilize fluid jets to break up, liquefy, and motivate tank material. The invention can work with tanks having high temperature or low temperature conditions and tanks having hazardous vapors, dusts, or the like.

BACKGROUND AND PRIOR ART

Tanks used for waste storage can be cleaned using handheld water nozzles. This is slow, tedious, and inefficient with potential danger. Personnel working in these environments would be exposed to hazardous and potentially flammable fluids, dusts and vapors in addition to strenuous conditions due to the requirement for the use of protective gear. Also, this work mostly performed in confined spaces that require scaffolding or lifts, make it cumbersome to use the requisite handheld blast equipment. Handheld blast nozzles produce high velocities and high thrust forces that an operator must counteract. This leads to fatigue and injury.

More sophisticated, robotically control systems have been employed but are limited due to visibility. Since the area is dangerous and inaccessible by humans, remotely operated cameras are required. This is also slow, tedious, and inefficient as this only provides a limited viewing area in a dark tank, with limited light, making it difficult for cameras to capture images with adequate detail and contrast. Additionally, mist and airborne particles common in waste storage tanks can obstruct the camera view and render it useless. More challenging is how an operator is required to visually survey the area to determine the appropriate cleaning pattern given the limited visibility of the camera.

"Dumb" systems with rotating, oscillating, or self-propelled nozzles have been employed; however, this method cleans everything in its path, 360 degrees, in all directions, whether it needs to be or not. This is extremely inefficient especially in typical situations where waste only resides in the bottom of a tank. This all or nothing method wastes resources, e.g., water, electricity, etc., and induces extensive cycle times. Also, these systems are a set and go method; so if not set properly, isolated areas requiring more extensive cleaning are left with waste still intact. An operator then has to visually survey the area, reset the parameters, and perform the cleaning operation again.

Thus, the need exists for solutions to the above problems with the prior art.

This application seeks to provide a semi-automated or automated solution that solves the above challenges and reduces overall cycle times.

SUMMARY OF THE INVENTION

A primary objective of the present invention is to provide manual, automated, or semi-automated devices, systems and methods incorporating nozzles which utilize fluid jets to break up and liquefy tank material such as oil and tar, or any other chemical, radioactive, or hazardous liquid, solid, or sludge waste material in oil field tanks, ballast tanks, void tanks, floating roof tanks, and rail tank cars.

A secondary objective of the present invention is to provide manual, automated, or semi-automated devices, systems and methods incorporating nozzles which utilize fluid jets to break up and liquefy tank material will operate in any tanks containing hazardous vapors, dusts, and the like.

An embodiment of the nozzle assembly can include a single low pressure, high flow fluid jet operating at pressures up to, but not limited to, approximately 5000 psig at a flow rate ranging from approximately 10 to approximately 500 GPM. In a further embodiment, a high pressure, low flow jet working up to, but not limited to, a pressure range from approximately 5,000 psig to approximately 50,000 psig, at a flow rate range from 0 to approximately 50 GPM can be integrated. In another embodiment, a plurality of high flow, low pressure and high pressure, low flow fluid jets can be incorporated in various combinations and orientations.

The fluid jet(s) can be twisted and rotated to direct the liquid stream as needed with two degrees of freedom, pan and tilt. The first degree of freedom, known as pan, can be described by approximately 360 degrees of rotation about a longitudinal, vertical axis. The second degree of freedom, known as tilt, can be described by approximately 360 degrees of rotation of the fluid jet(s) about a plane parallel the longitudinal, vertical axis. To further enhance the degrees of freedom, the versatile mounting features of the nozzle assembly allow it to be attached to the distal end of any boom, robotic arm, beam, or gantry system.

Each degree of motion can be rotated by a hydraulic actuator. A hydraulic power unit (HPU) provides pressurized fluid to electronically controlled valves which in turn modulates fluid flow to the actuators. The valves can be, but not limited to, servo valves or servo-proportional valves and are mounted on a manifold. The HPU can include, but not limited to, the requisite hydraulic pump driven by an electric motor to supply the system with flow and pressure of hydraulic fluid from an integrated storage reservoir. Supply and return hoses connect between the hydraulic power unit and the hydraulic manifold.

The hydraulic manifold can be, but not limited to, a block of steel or stainless steel machined with varying passageways to distribute hydraulic fluid to a plurality of valves mounted along the surfaces of the block. Mounted on the manifold frame, a control panel enclosure houses a motion controller that sends and receives inputs and outputs (I/O) in order to control the above valves.

In a preferred embodiment, the hydraulic valve manifold and control station will reside as near the tank but out of any classified hazardous or explosive area. In one embodiment, the hydraulic valve manifold and control station can be equipped with explosion proof or intrinsically safe components allowing operation in a classified hazardous zone where flammable gases or dust may exist. In an additional embodiment, the invention can be operated from a remote console station up to approximately 1000 feet away. In an alternate embodiment, control components can reside in a purged and pressurized enclosure rated for the hazardous environment.

The control station can include, but not limited to, a human machine interface (HMI) housed in an enclosure rated for outdoor operation. The HMI can include, but is not limited to, software, display screen, keyboard, pushbuttons, switches, and joysticks used to control and interact with the nozzle assembly. The HMI will allow an operator to monitor and manipulate the process real-time.

Also, as the Programmable Tank Cleaning Nozzle is processing one section, an operator can sit at the HMI and develop the toolpath for the next process. Manual manipulation can be done remotely at the human machine interface (HMI) in conjunction with cameras and pointers. In a further embodiment, the nozzle assembly can be manipulated by an operator through controls on a handheld remote control.

In a preferred embodiment, the device can use hydraulic power to manipulate nozzle assembly providing safe operation in environments with flammable vapors or dusts. Another embodiment of the device can use explosion proof linear actuator and/or electric motors to manipulate the nozzle assembly. The motors and actuators would be connected to power and signal cables coming from the device within the tank section being cleaned to an electrical motion controller and power supply residing in the control station located outside the classified hazardous area.

Automatic manipulation can be achieved through predetermined motion profiles that are calculated through software using kinematic algorithms. These profiles are interpolated around selected features, surface profiles or areas in the tank. Using cameras, pointers, distance sensors, and a remote controller, the nozzle assembly can be positioned at specific points relative to the work. By establishing multiple points around a feature or set of features, a list of coordinates can be generated. This gives the invention intelligence by storing these features as recipes and patterns that allow for efficient removal and cleaning of the tanks and removal of debris.

The remote controller can include but is not limited to, a handheld box containing the appropriate buttons, switches, and joysticks to control the nozzle from any location. The camera can be integrated into the nozzle assembly and can include, but not limited to, industrial grade monochromatic camera with lighting capable of transmitting a high resolution, live image to a remote screen. In further embodiments, the camera and/or lighting cab be intrinsically safe or explosion proof. Features of the camera can include pan, tilt, and zoom. The laser pointer can be, but not limited to, a device mounted to nozzle assembly capable of projecting a visible dot on a surface of a tank indicating the line of sight of the end effector.

The distance sensor can include, but is limited to, ultrasound, radiofrequency or laser such as a time-of-flight laser sensor that transmits light at a surface. The sensor can then determine the amount of time it takes (time-of-flight) to receive the light reflected off said surface. Using the known speed of light, the sensor can calculate the relative distance.

Dedicated software can draw lines or curves from point to point in such a way to form basic geometries such as squares, rectangles, circles, and so forth. These lines provide a map to be used as path, i.e. toolpaths that the nozzle assembly can follow as programmed. A controller takes this data and outputs the command signals to corresponding servo valves or servo-proportional valves; therefore, synchronizing the multiple axes and effectively moving the nozzle assembly along the desired path. The controller will also sequence events as needed.

Servo valves can be, but not limited to, a valve that uses analog electrical signals ranging from, but not limited to, 0 to approximately 100 milliamps to modulate a spool to precisely control hydraulic fluid flow to a hydraulic cylinder or motor. A servo-proportional valve can be, but not limited to, a valve that operates on the same principal as a servo valve but is constructed with looser tolerances and operates with less precision. Servo-proportional valves can also operate on analog electrical signals ranging from, but not limited to, 0 to approximately 100 milliamps as well as voltage signals ranging from, but not limited to, +/−approximately 40 VDC.

Further objects and advantages of this invention will be apparent from the following detailed description of the presently preferred embodiments which are illustrated schematically in the accompanying drawings.

BRIEF DESCRIPTION OF THE FIGURES

The drawing figures depict one or more implementations in accord with the present concepts, by way of example only, not by way of limitations. In the figures, like reference numerals refer to the same or similar elements.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification does not include all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

A list of components is listed below.

Figure 1:
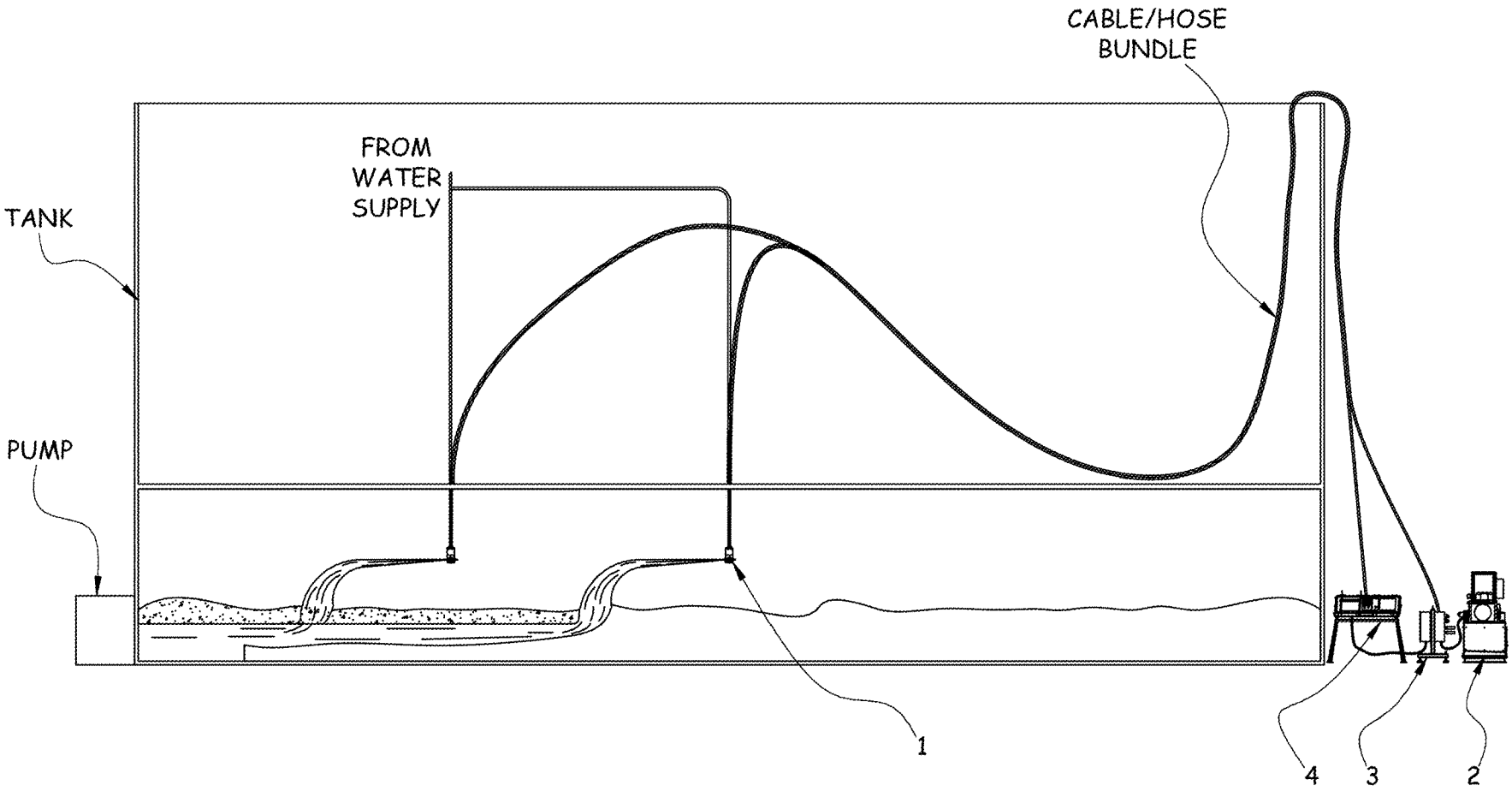
FIG. 1 is an elevation view of the Programmable Tank Cleaning Nozzle in a generic tank.
Figure 1A:
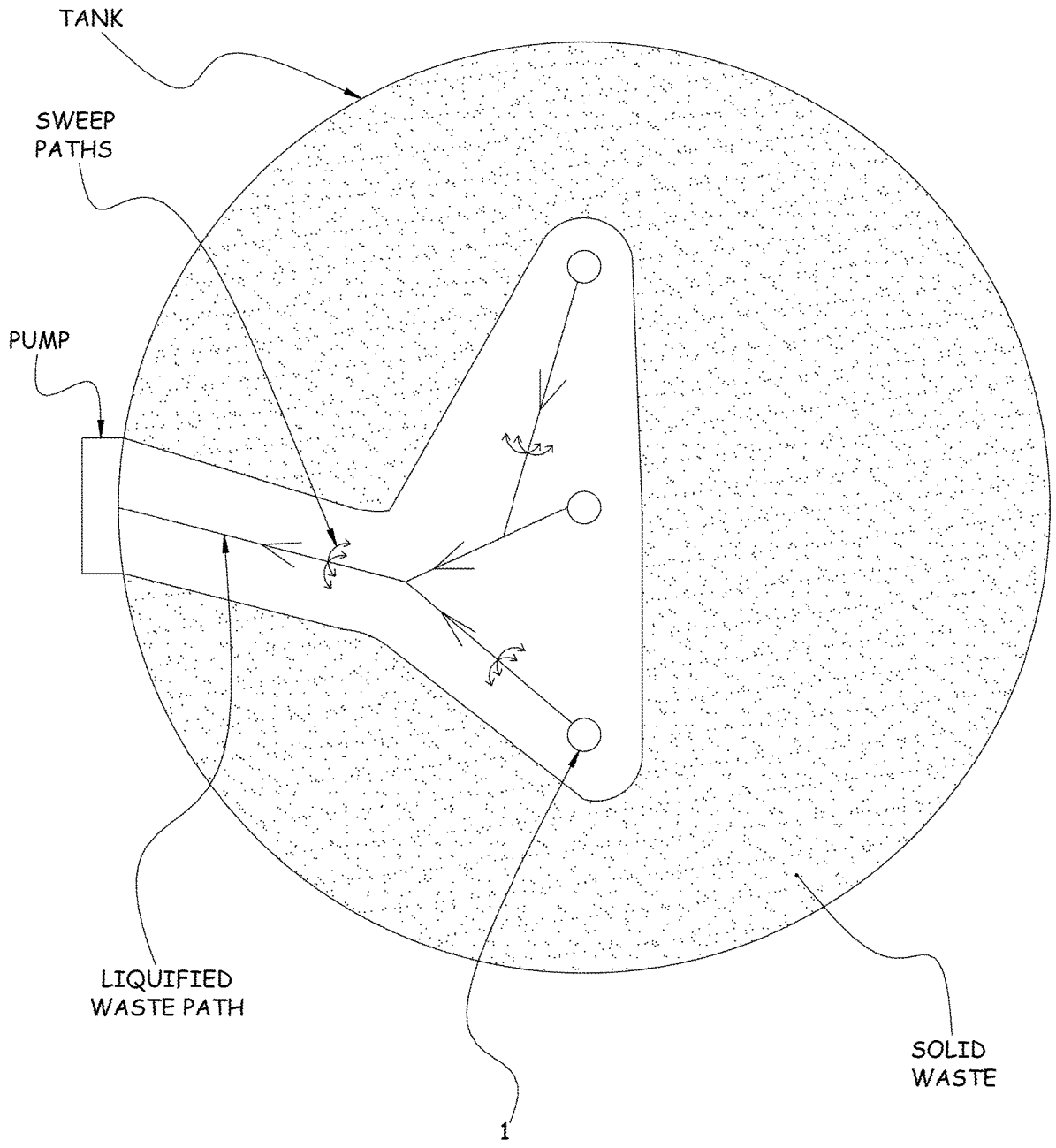
FIG. 1A is a diagram illustrating multiple nozzles working in concert to cutaway solid waste and direct the fluid to a common retrieval pump.

1 nozzle assembly
2 hydraulic power unit (HPU)
3 hydraulic manifold
4 control station
5 remote control station
13 mounting plate
14 stationary upper housing assembly
15 a rotatable lower housing assembly
16 rotatable fluid jet nozzle assembly
17 groove coupling
18 quick disconnect couplings
19 hydraulic hoses
20 Bulkhead connector
21 housing
22 fluid flow tube
23, Pan motor assembly
24 Tilt motor assembly
25 O-ring
26 pin
27 seal
28 spring
29 threaded housing
30 drive gear
31 hydraulic motor
32 intermediate gearsets
33 parallel shaft
34 internal tooth ring gear
35 corresponding shaft
36 final gear
37 gear
38 rigid hydraulic conduit
40 drive gear
41 hydraulic motor
42 intermediate gearsets
43 parallel shaft
44 internal tooth ring gear
45, 46 bevel gearset
47 corresponding shaft
48 final gear
49 gear
50 Fiber optic encoder
51 encoder gear
52 homing sensor
53 target
55 pan gear shear pin
56 tilt gear shear pin
60 cylindrical housing
61 upper support bushing
62 bushings
63 rotary seals
64 wear sleeves
65 bottom cap
66 fluid conduit
67 rotary seals
68 wear sleeves
69 bolt on cap
70 low pressure/high flow fluid jets
71 O ring
72 Cylindrical hub
73 Bushings
75 manifold block
76 precision servo valves
77 hydraulic circuit components
78 electrical panel
79 common frame structure
80 user screen
81 keyboard
82 mouse
83 pushbuttons
84 joystick controllers
85 portable control station
86 multi screens
87 portable stand
88 central processing unit (CPU)
89 Switches
90 touchscreen
91 pushbuttons
92 joystick controllers
93 handheld case
94 electrical cable
95 one or more switches
100 O-ring boss fitting
101 O-ring
102 hydraulic fitting
104 O-ring
106 intermediate plate FIG. 1 is a perspective view of a programmable tank cleaning nozzle system according to a preferred embodiment of the invention. The system can be comprised of a nozzle assembly 1, hydraulic power unit (HPU) 2, hydraulic manifold 3, and control station 4.

Figure 2:
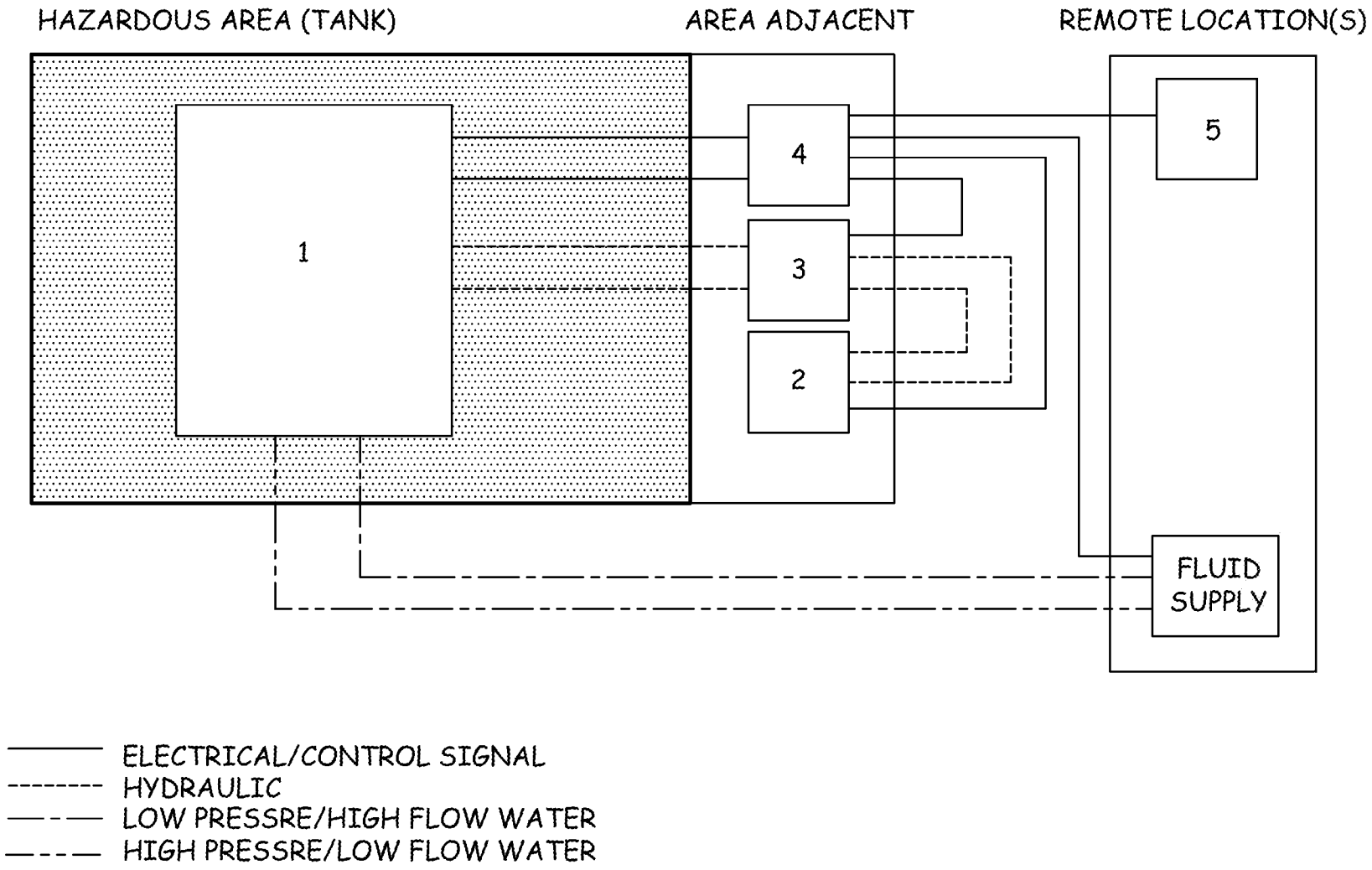
FIG. 2 is a block diagram of the top-level control system architecture.

FIG. 2 shows the top level system architecture where the nozzle assembly 1 can be mounted in an area with hazardous dust and vapors where the HPU 2, hydraulic manifold 3 and control station 4 can be located adjacent the classified area, but outside any classified, hazardous area. In certain embodiments, a remote control station 5 can be mounted up to approximately 1000 feet away.

The present invention can be connected to the hydraulic power unit 2 that is comprised of, but is not limited to, the requisite hydraulic pump driven by an electric motor to supply the system with flow and pressure of hydraulic fluid from an integrated storage reservoir. Supply and return hoses connect between the hydraulic power unit and the hydraulic manifold. Flexible cables can provide electrical and control signals between the control station 4, HPU 2, and hydraulic manifold 3.

In a further embodiment, interconnect wiring can allow communication and/or discreet I/O between the Programmable Tank Cleaning Nozzle and any fluid supply system. Communication could include, but not limited to, Ethernet, Profibus, DeviceNet, or any other network protocol or fieldbus communication protocol. In the preferred embodiments, fiber optic cables/wires are used for use in hazardous explosive environments.

Figure 3:
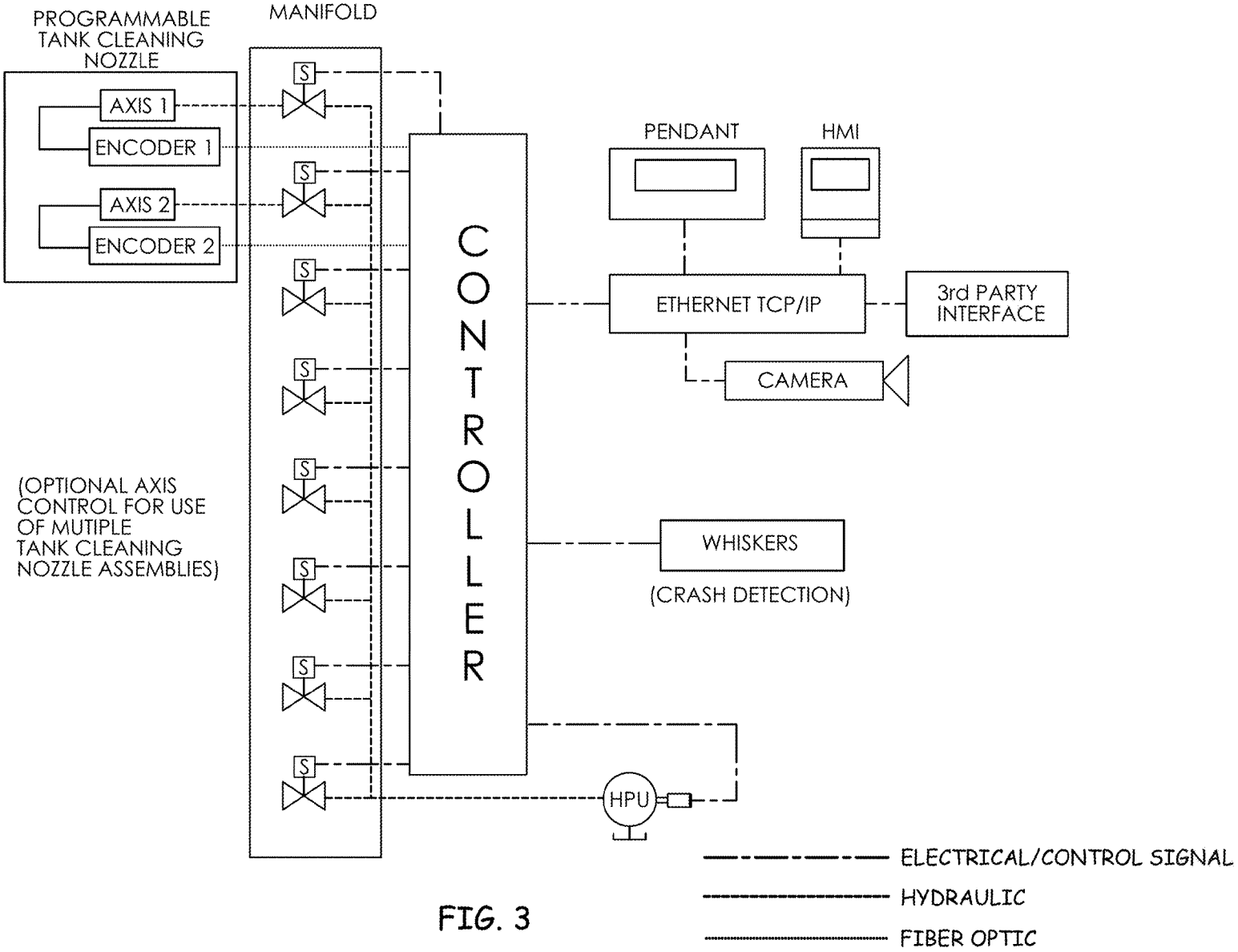
FIG. 3 is a block diagram of the preferred control layout using fiber optic feedback.

FIG. 3 shows a preferred control layout where 2 axes with closed loop control from a hydraulic controller receives commands from the control station 4 to drive either a servo valve or proportional servo valve corresponding with each axis. The controller can output to one or more axes for control of a single nozzle assembly with one or more degrees of freedom.

In a further embodiment, the controls can output to one or more nozzle assemblies with one or more degrees of freedom. The HPU 2 provides a constant supply of hydraulic oil to valves on a manifold that in turn modulates the flow to corresponding hydraulic motors and/or actuators based on encoder feedback and toolpaths developed by software at the control station. Encoder feedback can be, but not limited to, absolute or incremental positional data sent to the motion controller through a serial interface for closed loop control of the hydraulic actuators.

For operation in classified hazardous areas, the preferred embodiment incorporates fiber optic encoders. In an alternative embodiment, the encoders can be wired to isolation barriers for intrinsically safe operation. In environments not considered hazardous, the encoders can be any non-rated absolute or incremental encoder that is wired per methods according to the application and applicable codes. In further embodiments, resolvers could be used in lieu of encoders.

The third-party interface referenced in FIG. 3 can include, but is not limited to, communication and/or discreet I/O between the Programmable Tank Cleaning Nozzle and any fluid supply system, robotic arm, boom, or ancillary control system from an outside source. Communication could include, but not limited to, Ethernet, Profibus, DeviceNet, or any other network protocol or fieldbus communication protocol. Discreet I/O could include, but not limited to, run/stop signals, on/off signals, safety interlocks, and the like.

Figure 4:
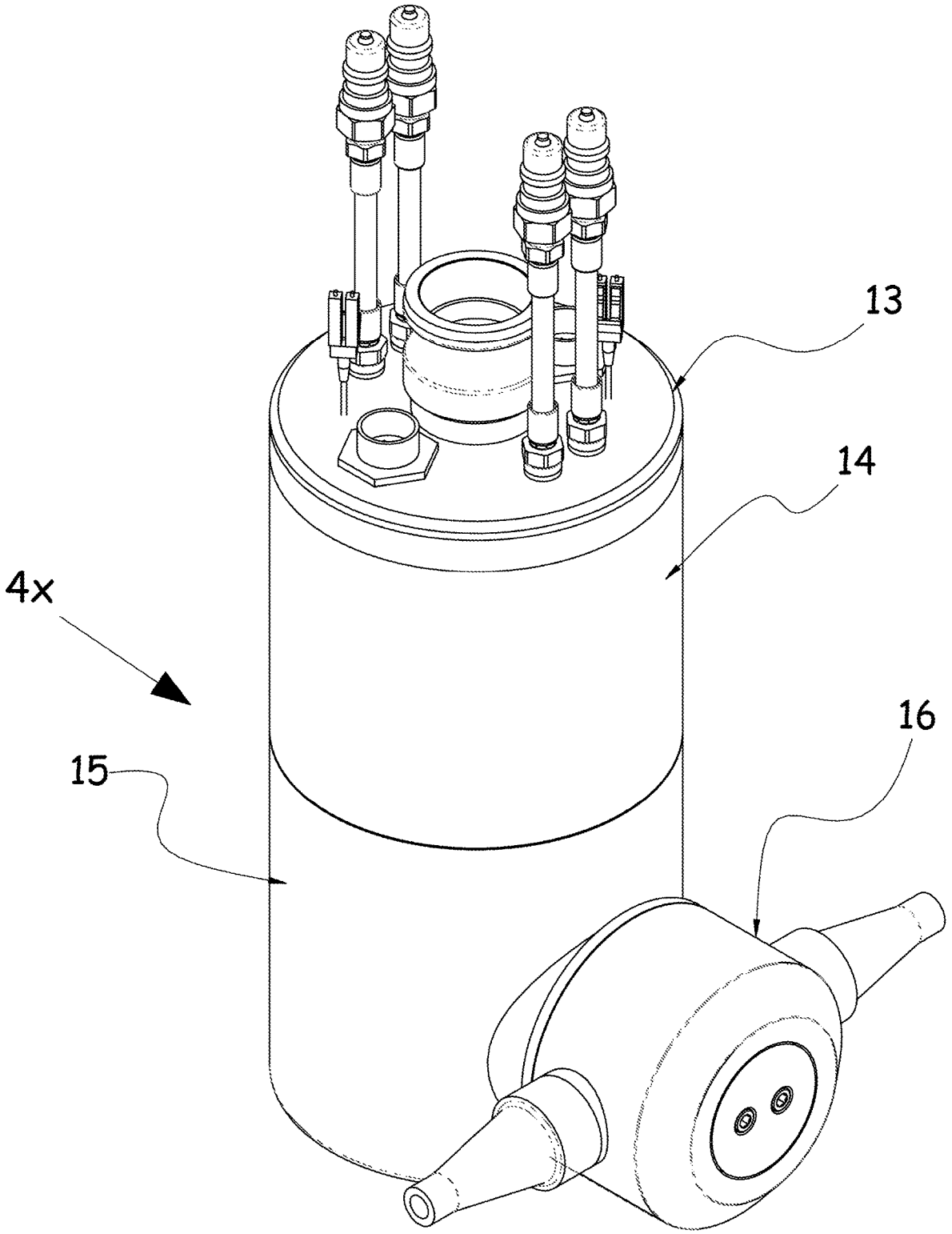
FIG. 4 is a perspective view of the nozzle assembly of FIG. 1.

FIG. 4 shows a nozzle assembly comprised of a mounting plate 13, stationary upper housing assembly 14, a rotatable lower housing assembly 15, and rotatable fluid jet nozzle assembly 16.

Figure 5:
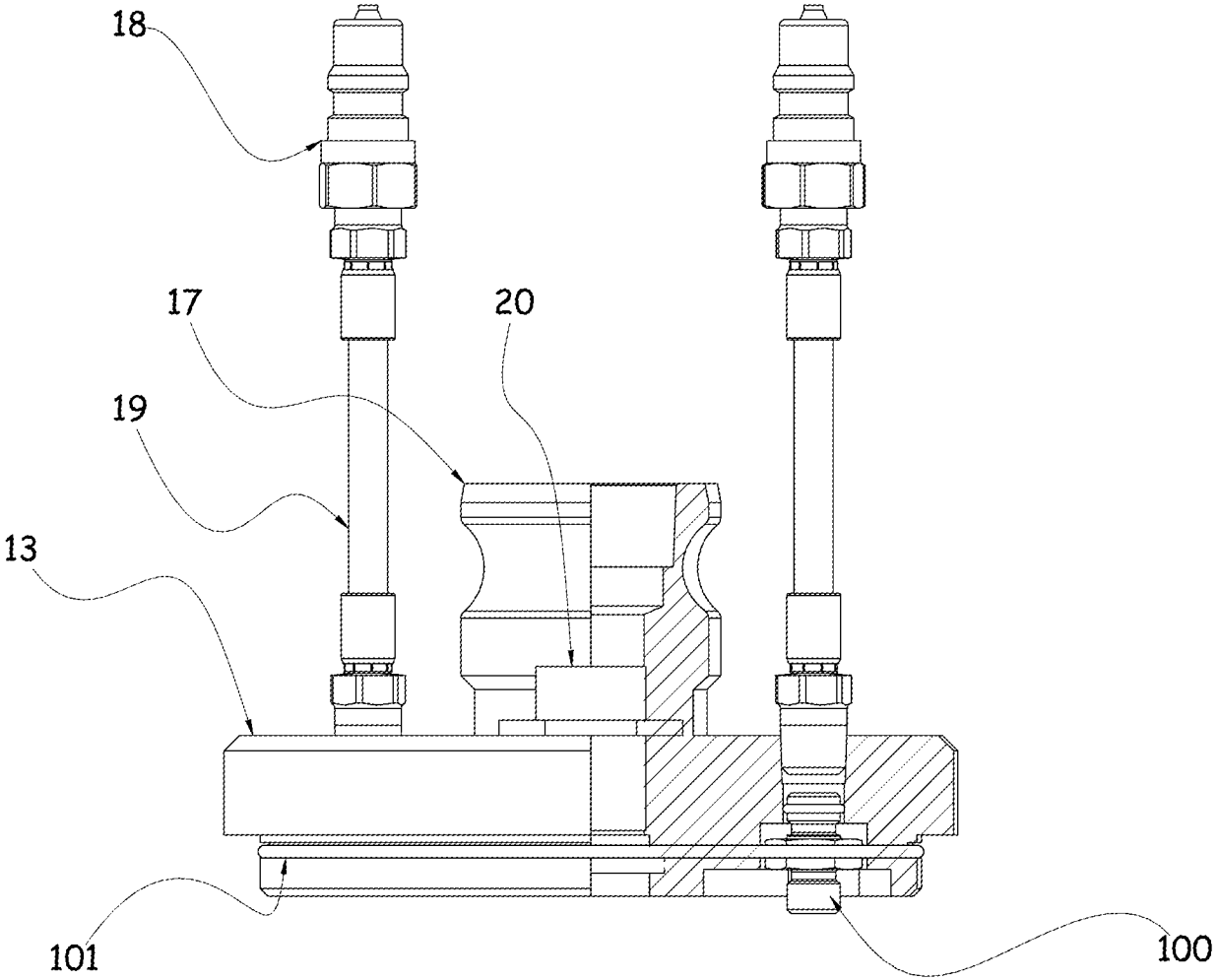
FIG. 5 shows the a broken-out section view of the mounting plate assembly used in FIG. 4.

FIG. 5 shows a customizable mounting plate 13 affixed atop the nozzle assembly 1. This allows the nozzle assembly 1 to be mounted to any structure. In the preferred embodiment, the mounting plate 13 is comprised of a machined plate and cam and groove coupling 17, a.k.a. cam-lok coupling, that acts as the fixture point as well as the connection point for the fluid source. The coupling could range from approximately ½" up to and beyond approximately 6".

In alternative embodiments, the mounting plate 13 can be comprised of any pipe flange, tapered pipe thread, or any other customized flange, coupling or plate. To further enhance the degrees of freedom, the nozzle assembly can be attached to manways, holes, booms, robotic arms, rigid beams, gantry systems or any other features or devices with adequate structural stability.

In a preferred embodiment, hydraulic fluid passages are incorporated into the plate where on the bottom side, there is direct interface with an O-ring boss 100 extending from the hydraulic motor ports, and on the opposing side are connection ports for quick disconnect couplings 18.

The ports can be tapered or straight pipe fittings and could include an O-ring face. In a further embodiment, hydraulic hoses 19 can used to extend the quick couplings away from any encumbrances. In an additional embodiment, cross drilled passages can be used to locate the ports in any orientation on the plate. Bulkhead connectors 20 for any electrical or fiber optic signal cables are also mounted to the plate. The mounting plate 13 mounts to the top housing assembly 14 and seals with an O-ring 101.

Figure 5A:
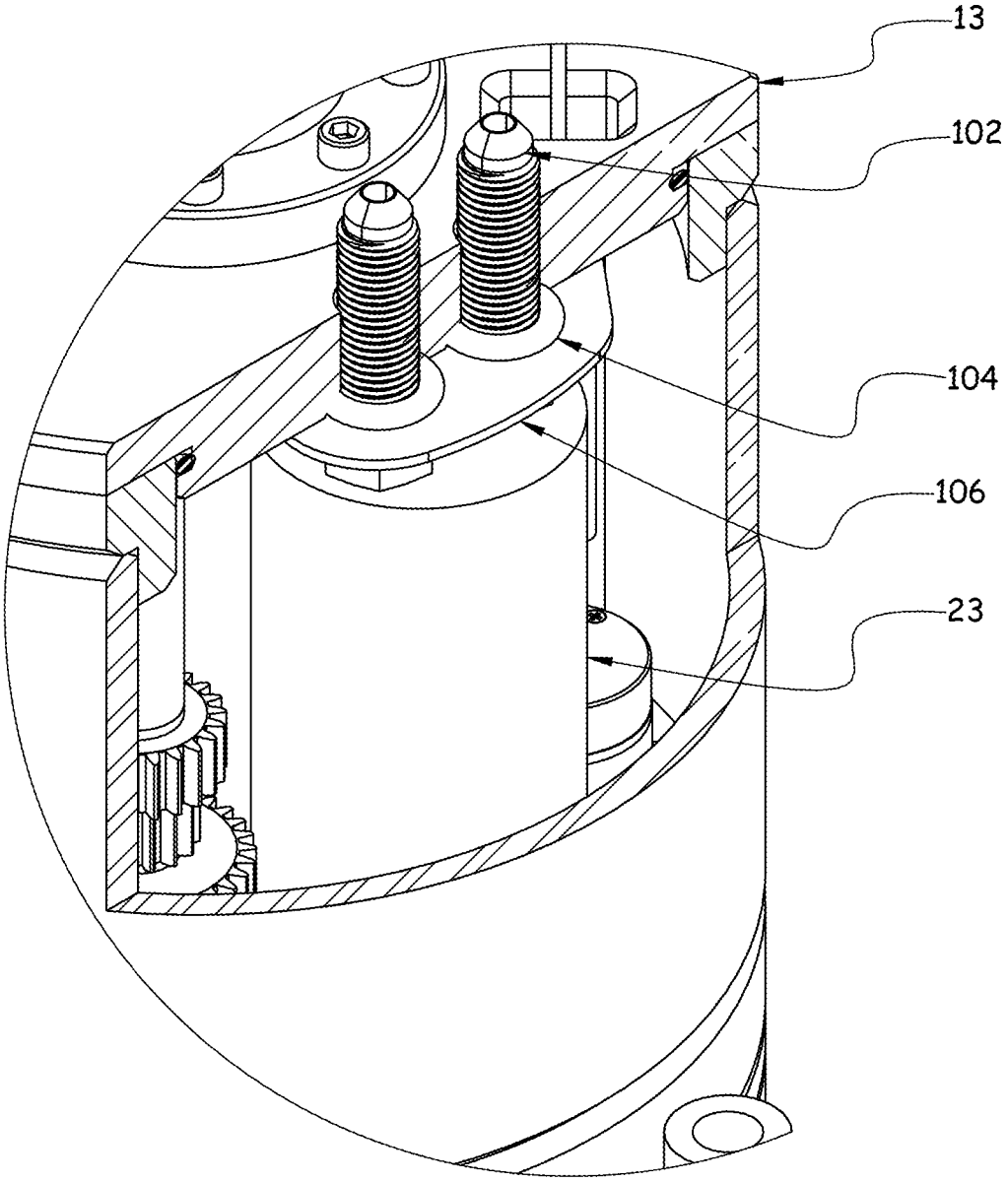
FIG. 5A is an alternate broken out section view of FIG. 4 along arrow 4*y*.

FIG. 5A depicts an alternate embodiment where hydraulic fittings 102 are affixed to the hydraulic motors 23, 24 and extend through the mounting plate 13. An O-ring seal 104 is compressed between the mounting plate 13 and an intermediate plate 106 to prevent the ingress of any fluid or debris into the stationary upper housing assembly 14. The hydraulic hoses 19 with quick disconnect couplings 18 of FIG. 5 can be connected to the hydraulic fittings. Alternately, any hydraulic hose(s) with the correct corresponding hose ends can be directly coupled to the hydraulic fittings 102.

Figure 6:
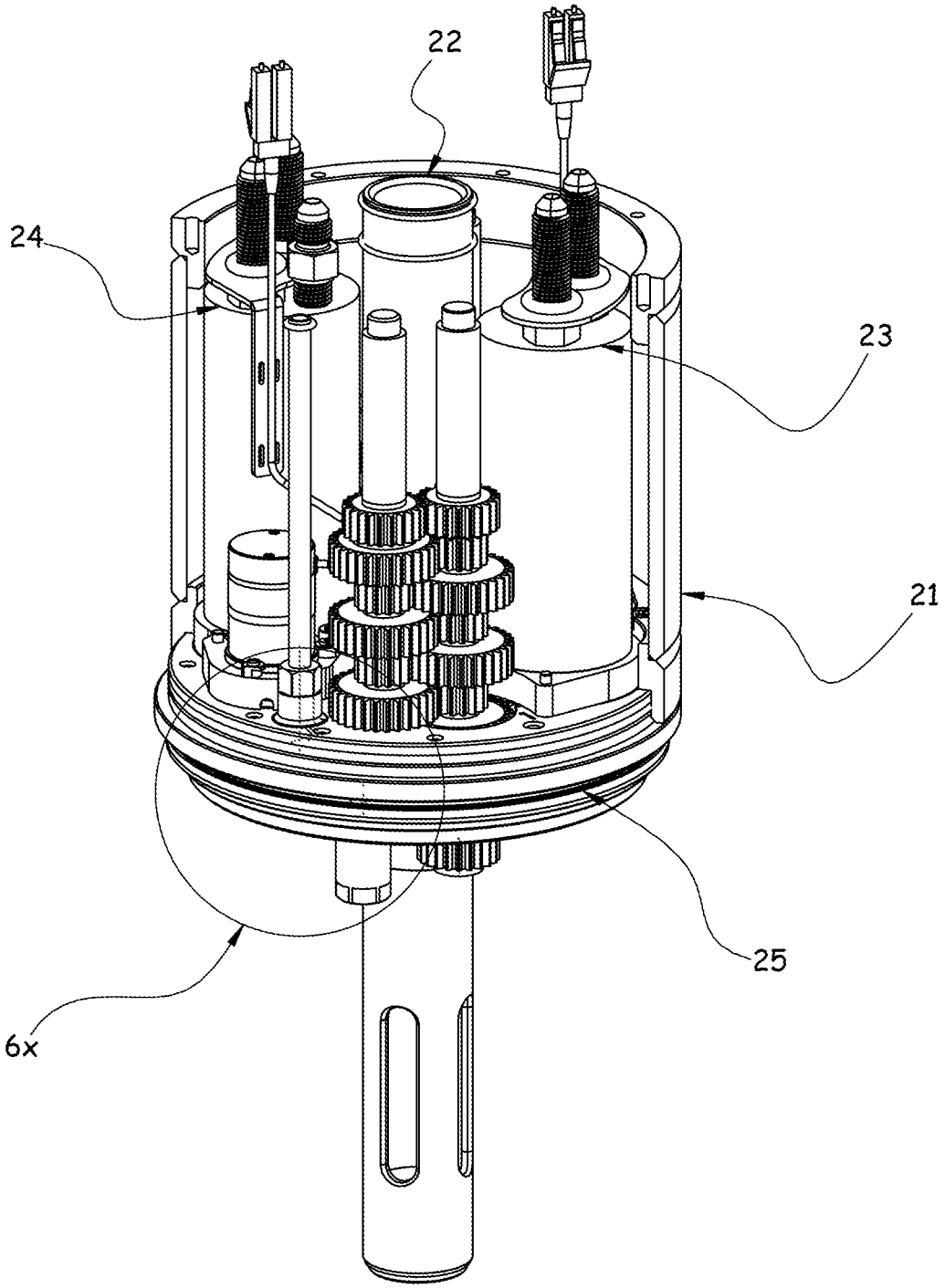
FIG. 6 is an isometric view of the top housing assembly with broken-out section of FIG. 4.

FIG. 6 shows an upper housing assembly 14 is comprised of two hydraulic motors secured in a cylindrical housing. The housing 21 can be made of stainless steel, aluminum, or carbon steel and be comprised of machined components, cast components, welded components, or a combination thereof. The housing can be bare metal or coated with a protective coating such as, but not limited to, electroless nickel, anodizing or chrome plating. Integral to the housing, is a fluid flow tube 22.

Each motor assembly 23, 24 can be coupled to a precision gear train where one rotates the lower housing assembly 15 and the other rotates the fluid jet nozzle assembly 16; thus, providing two degrees of freedom known as pan and tilt. Pan, can be described by approximately 360 degrees of rotation of the lower housing assembly about the longitudinal, vertical axis. Tilt can be described by approximately 360 degrees of rotation of the fluid jet(s) about a horizontal axis perpendicular to the longitudinal, vertical axis. The upper housing assembly mates with the lower housing assembly and is sealed with an O-ring 25.

Figure 6A:
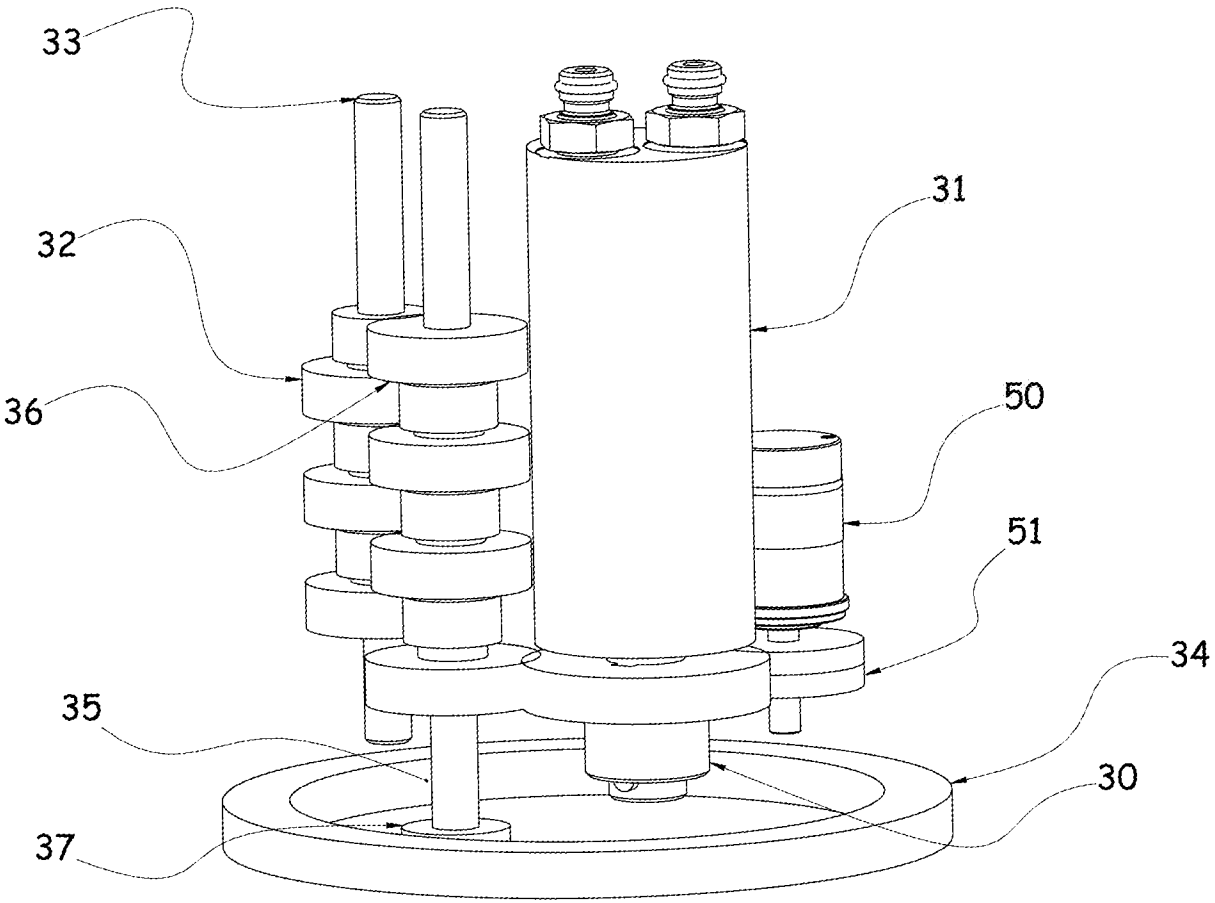
FIG. 6A is a perspective view of a pan axis comprising a gear train and hydraulic motor of FIG. 6.

Referring to FIG. 6A, the pan axis motor assembly 23 can be comprised of a drive gear 30 on the output shaft of a hydraulic motor 31 driving the lower housing gear train which is comprised of a double row of intermediate gearsets 32 configured in a parallel shaft 33 and 35 arrangement that is finally meshed to an internal tooth ring gear 34. Each intermediate gearset 32 incorporates two gears of varying pitch diameters that are fixed together and are allowed to freewheel on its corresponding shaft 33, 35.

The gears can be staged such that rotation of the first gearset causes rotation of the second meshed gearset on the adjacent shaft which in turn drives the third gearset on the previously mentioned shaft and so forth and so on until the final gear 36 in the stack is reached. This gear is fixed to its corresponding support shaft 35 that extends back through one stack of gears in order to drive a gear 37 mounted on the opposing end. This gear can be meshed with an internal tooth ring gear 34 affixed to the lower housing assembly. Each stage causes a speed reduction and the number and sizes of gears are such that a final gear reduction range of approximately 40:1 up to approximately 400:1 can be achieved.

Figure 6B:
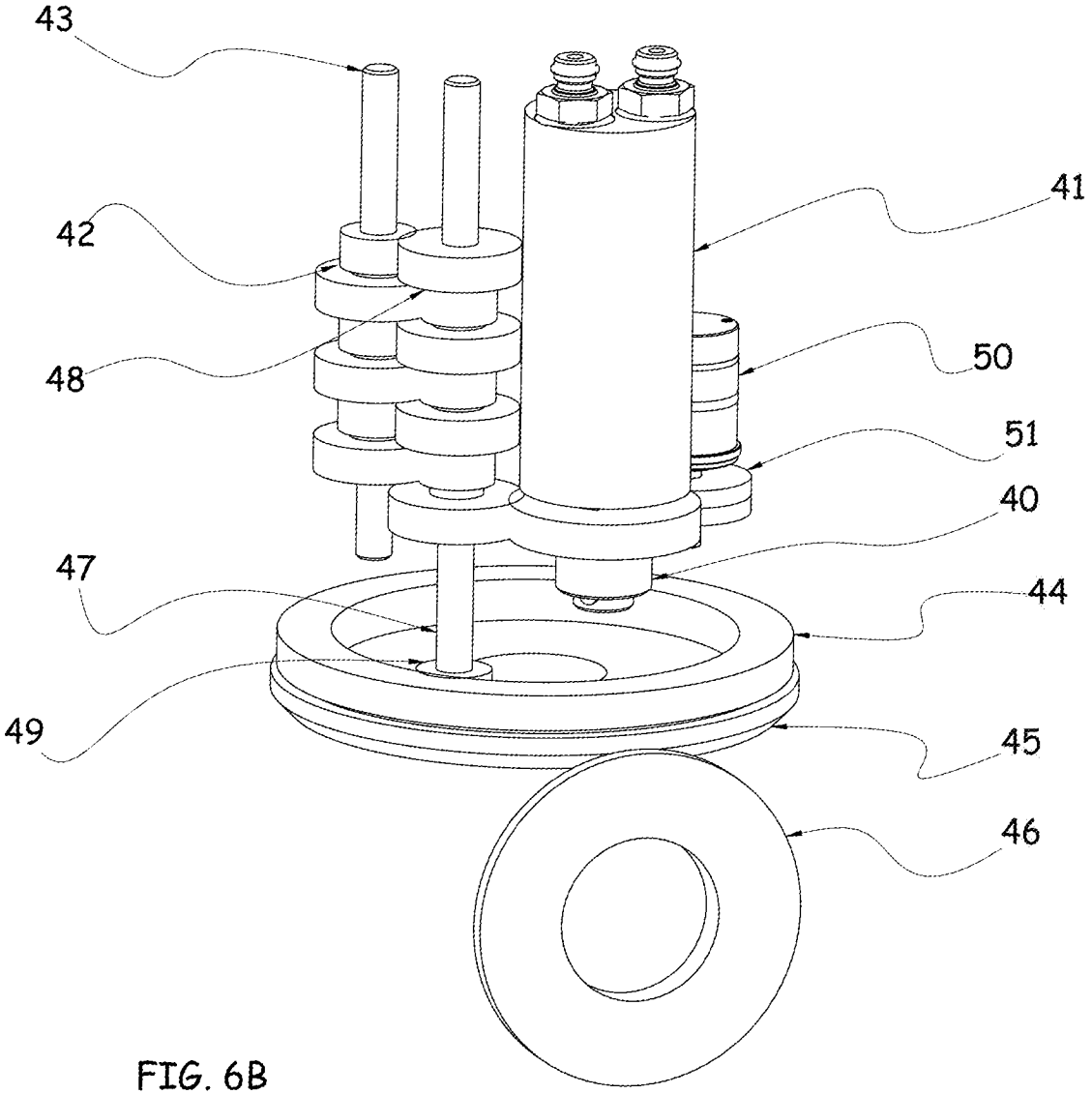
FIG. 6B is a perspective view of a tilt axis comprising a gear train and hydraulic motor of FIG. 6.

Referring to FIG. 6B, the tilt axis motor assembly 24 is comprised of a drive gear 40 on the output shaft of a hydraulic motor 41 driving the lower housing gear train which is comprised of a double row of intermediate gearsets 42 configured in a parallel shaft 43 arrangement that is meshed to an internal tooth ring gear 44 coupled to a bevel gearset comprised of 45 and 46. Each intermediate gearset 42 incorporates two gears of varying pitch diameters that are fixed together and are allowed to freewheel on its corresponding shaft 43, 47.

The gears can be staged such that rotation of the first gearset causes rotation of the second meshed gearset on the adjacent shaft which in turn drives the third gearset on the previously mentioned shaft and so forth and so on until the final gear 48 in the stack is reached. This gear is fixed to its corresponding support shaft 47 that extends back through one stack of gears in order to drive a gear 49 mounted on the opposing end. This gear is meshed with an internal tooth ring gear 44 affixed a bevel gear 45. A corresponding bevel gear 46 is situated at 90 degrees and is affixed to the fluid jet nozzle assembly. Each stage causes a speed reduction with exception to the bevel gear stage which is a speed increase. The number and sizes of gears are such that a final gear reduction range of approximately 40:1 up to approximately 400:1 can be achieved.

Referring to FIGS. 6A and 6B, an encoder 50 can be coupled to each hydraulic motor for closed loop, positional feedback control. For operation in classified hazardous areas, the preferred embodiment incorporates fiber optic encoders. In an alternative embodiment, encoders can be wired to isolation barriers for intrinsically safe operation. The encoder can be either absolute or incremental. In the preferred embodiment, the encoder is equipped with an encoder gear 51 meshing with the output pinion 30, 40 of the hydraulic motor 31, 41. In a further embodiment, the gear can be anti-backlash to allow high resolution while eliminating errors due to gear slop. In the preferred embodiment, the anti-backlash gear can be a spring loaded split gear arrangement.

In other embodiments, the anti-backlash gear can be any spring loaded, tapered, or precision machining method available that reduces or eliminates backlash. Alternately, an encoder can be directly integrated internally to the motor with a flexible shaft. In a further embodiment, the encoder can be directly coupled to the output shaft of the motor with rigid or flexible coupling.

All or any combination of gears in the above embodiments can be manufactured from stainless steel, carbon steel, alloy steel, aluminum, bronze alloy, or plastic. In the preferred embodiment, the gears are heat treated. In other embodiments, they could be in the annealed state or case hardened. The gears can be lubricated using any grease, oil, or dry lubricant suitable for open gearing.

Figure 6C:
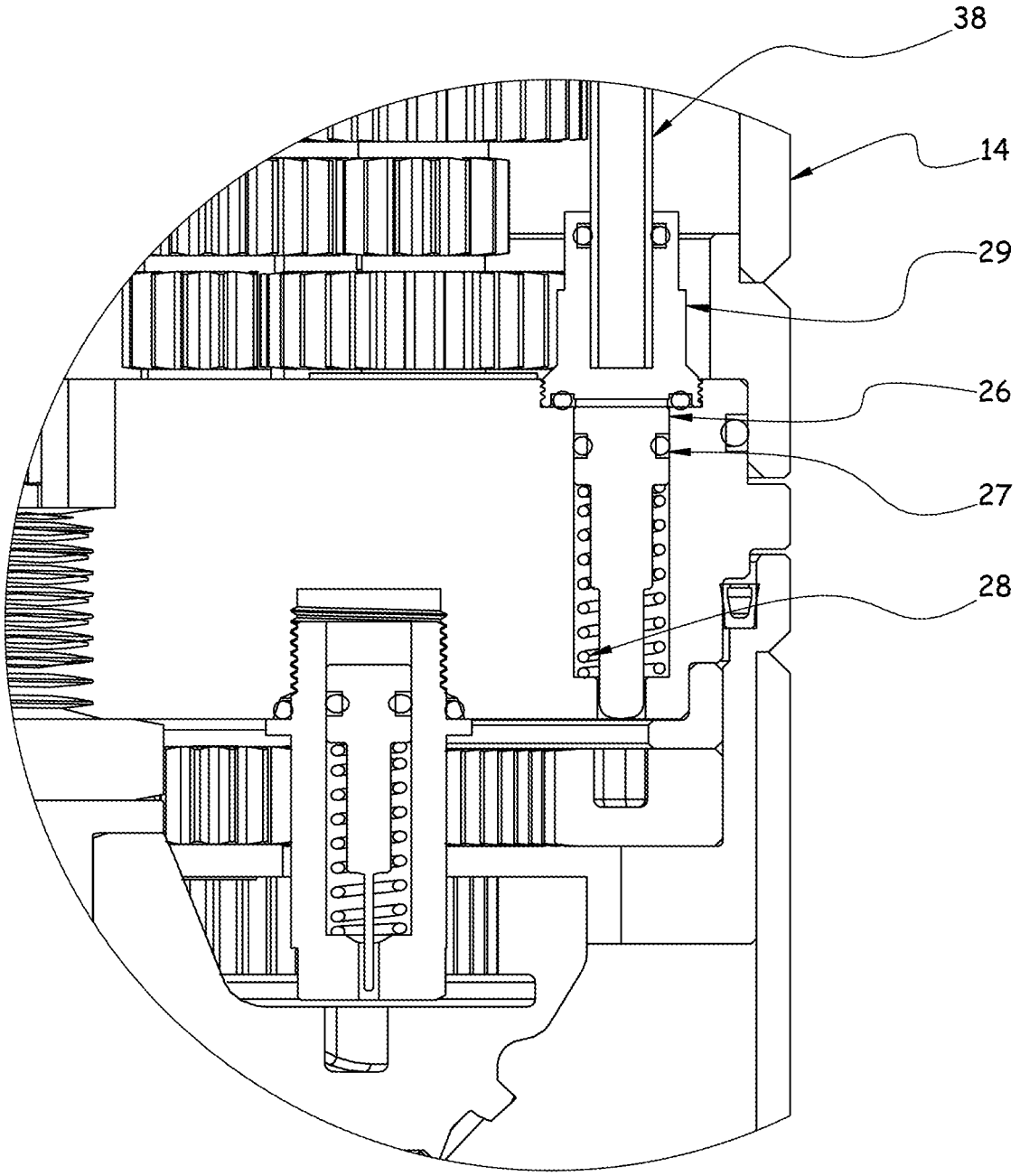
FIG. 6C is cutaway view of the upper stationary housing of FIG. 6 about the circle 6*x*.
Figure 6D:
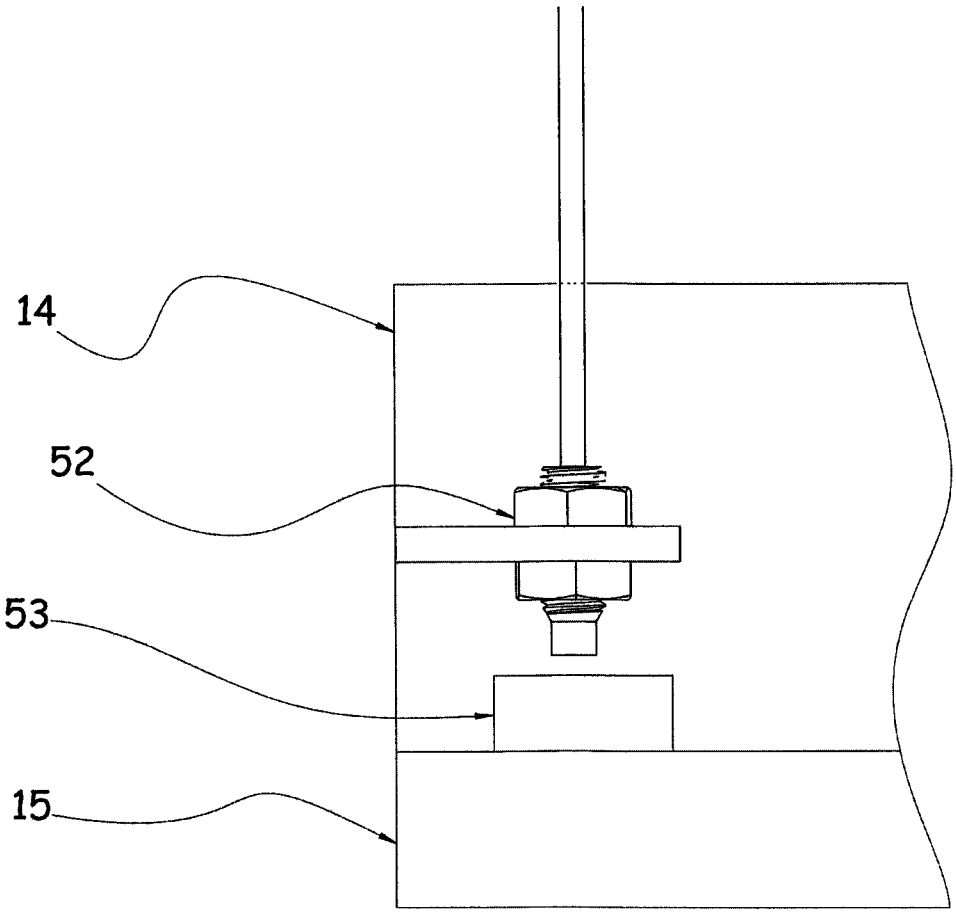
FIG. 6D is an illustration of a homing sensor arrangement in FIG. 4.

Referring to FIG. 6D, the embodiment can incorporate a homing sensor 52 mounted to a stationary point on the upper housing assembly 14. The homing sensor 52 can detect a target 53 mounted to a rotation part on the lower housing assembly 15. Once detected, the homing sensor 52 reports back to the controller a signal to stop rotation at a predetermined home position. For operation in classified hazardous areas, this embodiment incorporates a fiber optic sensor. The fiber optic sensor could be of the reflective or thru beam type. The target could be any solid object where a surface can be detected.

Alternately, the target could be a small diameter hole. In other embodiment, the sensor can be a proximity, laser, ultrasonic, or any other noncontact sensor. In further embodiments, the sensor can be such that it is wired to isolation barriers for intrinsically safe operation.

FIG. 6C refers to the preferred embodiment depicts a mechanical stops. comprised of pin assemblies mounted in the upper stationary housing 14 used to orientate each gear into a home starting position. The pin assembly is comprised of a pin 26, a seal 27, a spring 28 and a threaded housing 29 supplied with hydraulic fluid through a rigid hydraulic conduit 38. Each housing threads into the upper stationary housing 14 and is oriented parallel to the longitudinal axis of the nozzle assay. The pin contains features to hold the seal against a bore in the housing which guides the pin as it extends out. Hydraulic pressure extends and holds the pin, while a spring will retract the pin when pressure is relieved. This pin can be actuated against a flat surface on the gear. As the gear rotates, the pin is continuously pressed against the surface until it aligns with a slot cut into the gear. Rotation continues until the pin hits the end of the slot, a.k.a the stop, preventing further rotation. The slot can have a ramped lead-in to maintain continuous contact. Once both stops are engaged, the system control parameters can be adjusted back to the default home position. A rigid tube supplies hydraulic fluid to the uppermost pin assembly. Crossporting in the upper stationary housing 14 simultaneously diverts flow to the lower most pin assembly.

Figure 7:
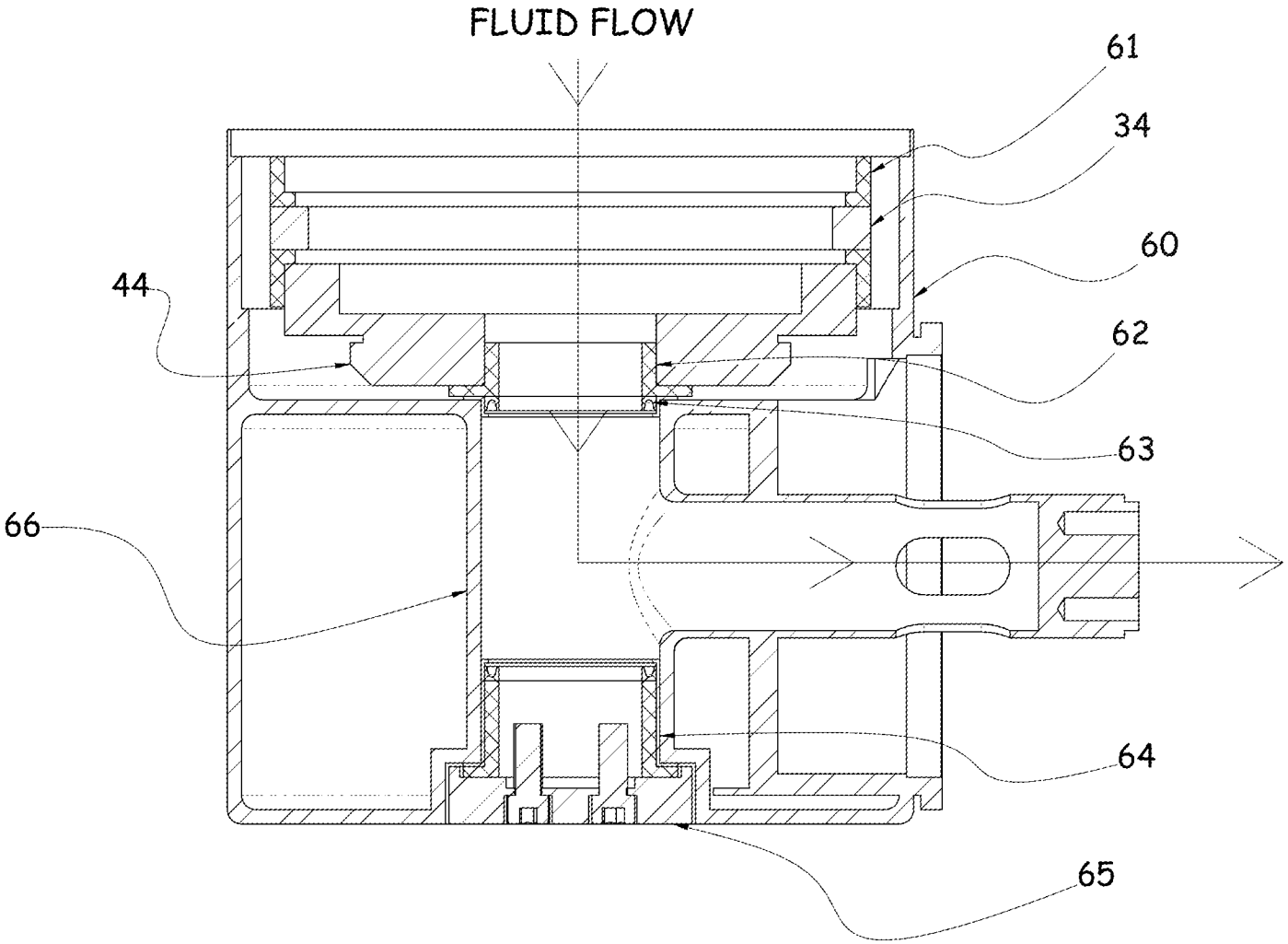
FIG. 7 is a section view of the lower housing assembly of FIG. 4.

FIG. 7 shows a lower housing assembly 15 comprised of a cylindrical housing 60, upper support bushing 61, bushings 62, rotary seals 63, wear sleeves 64, and bottom cap 65. Also housed inside is the internal tooth ring gear 34 and bevel gear 44 of FIGS. 6A and 6B. The housing 60 can be made of stainless steel, aluminum, or carbon steel and be comprised of machined components, cast components, welded components, or a combination thereof. The housing 60 can be bare metal or coated with a protective coating such as, but not limited to, electroless nickel, anodizing or chrome plating.

Integral to the housing, is a fluid conduit 66 where the flow tube on the upper housing assembly 14 passes through the seals 63 and top and bottom bushings 62 to permit the passage of high pressure, low flow liquids and/or low pressure, high flow fluids while simultaneously allowing 360 degrees of rotation. The hardened wear sleeves 64 eliminate wear from the rotary seals 63 rubbing on the outside diameter of the lower housing 15 bore.

From here on out, in the descriptions of the preferred embodiments, low pressure/high flow water is defined as, but not limited to, a pressure of up to approximately 5000 psig at a flow rate ranging from approximately 10 to approximately 500 gpm.

In another embodiment, the fluid can be high pressure/low flow. From here on out, in the descriptions of the preferred embodiments, high pressure/low flow is defined as, but not limited to, a pressure range from approximately 5,000 psig to approximately 50,000 psig at a flow rate range from 0 to approximately 50 gpm.

Figure 8:
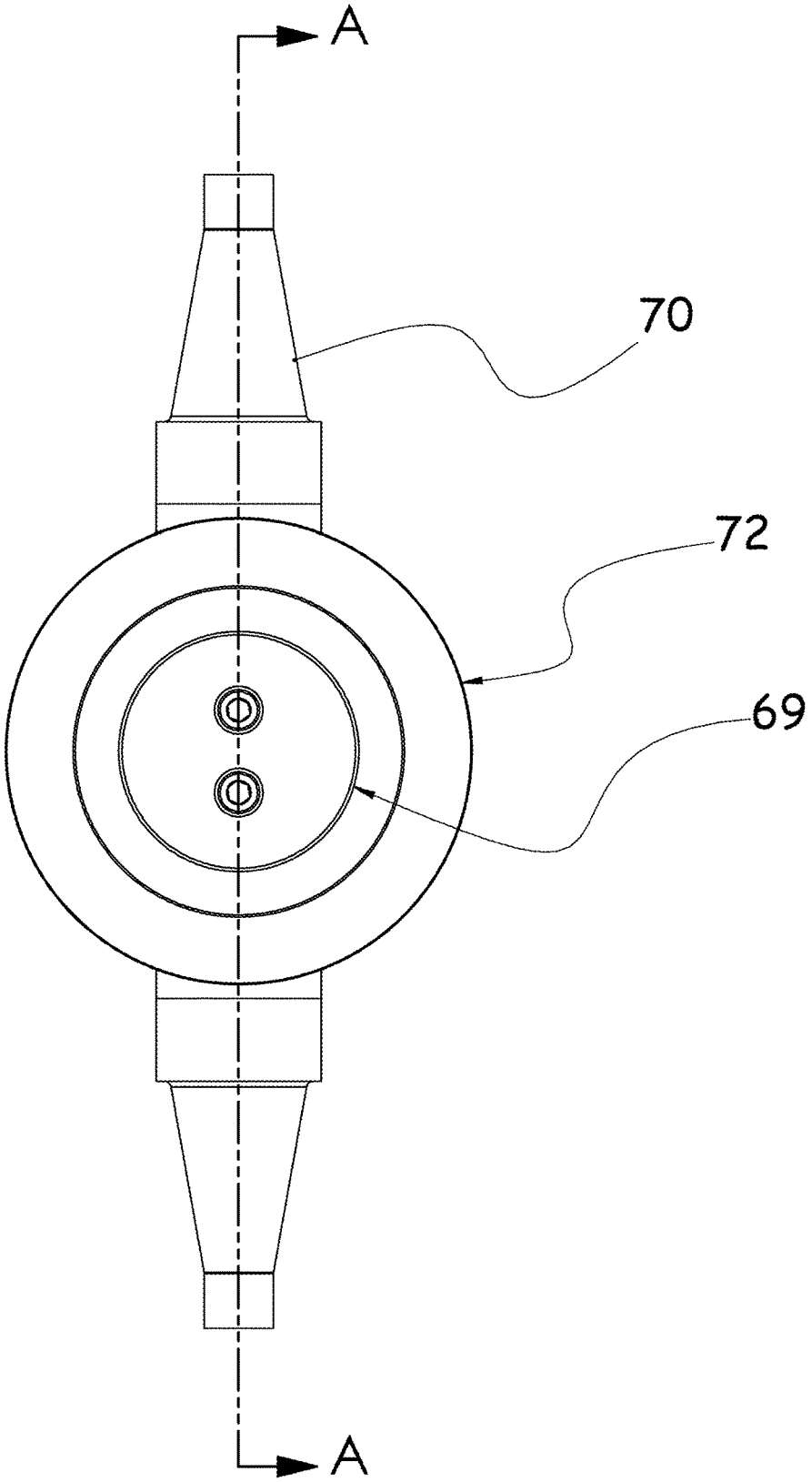
FIG. 8 is a front view of the fluid nozzle assembly of FIG. 4.
Figure 8A:
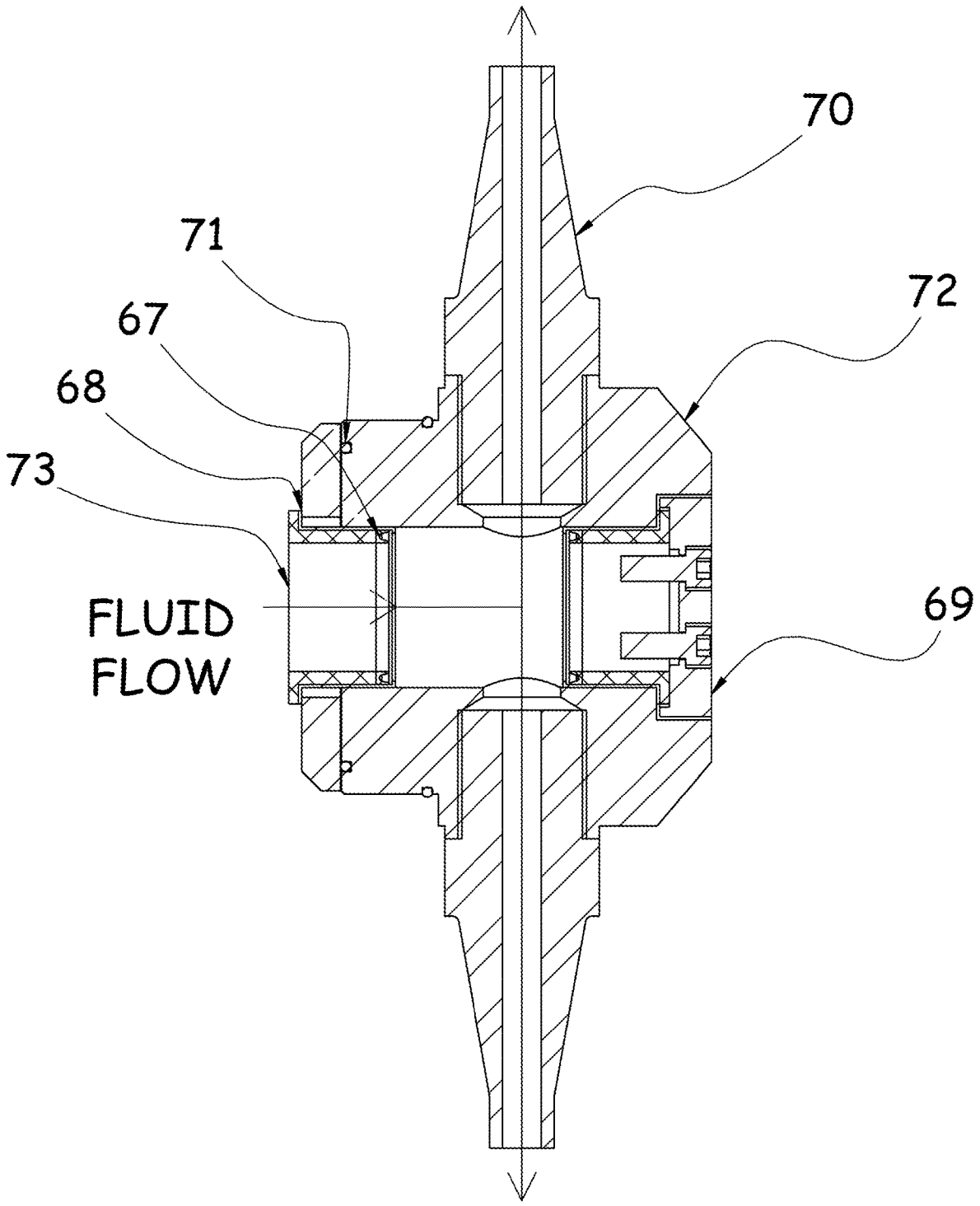
FIG. 8A is a cross-sectional view of the fluid jet nozzle assembly of FIG. 8 along arrows 8A.

Extending laterally approximately 90 degrees from the housing are features that allow mounting of the rotatable fluid jet nozzle assembly 16. The fluid jet nozzle assembly 16 of FIG. 8 and FIG. 8A can be comprised of a cylindrical hub 72, bushings 73, rotary seals 67, wear sleeves 68, bolt on cap 69, and low pressure/high flow fluid jets 70.

In another embodiment, a plurality of high flow, low pressure and high pressure, low flow fluid jets 70 can be incorporated in various combinations and orientations. The fluid jet nozzle assembly 16 mounts on to the lateral tube of FIG. 6 where the fluid flow passes through and exiting approximately 90 degrees through the fluid jets 70. The seals 67 and bushings 66 permit the passage of high pressure, low flow liquids and/or low pressure, high flow fluids while simultaneously allowing 360 degrees of rotation. The hardened wear sleeves 68 eliminate wear from the seals 67 rubbing on the outside diameter of the lateral tube of FIG. 6.

In the preferred embodiment, there are two opposing fluid jets 70, at approximately 180 degrees, to balance the trust forces. In particular embodiments, a single fluid jet can be implemented. In even further embodiments, 3, 4 or more fluid jets can be implemented.

All or any combination of rotary seals in the above embodiments can be manufactured from any low friction plastic, rubber, or metal. In the preferred embodiment, the rotary seals have low drag torque, chemical resistance and seal against high flow, low pressure and high pressure, low flow fluid. These seals can be constructed from virgin PTFE or PTFE with additives for wear, pressure, lubricity, static dissipation, and/or temperature. In a further embodiment, the bushings can be made from Polyphenylene Sulfide (PPS), with or without additives.

All or any combination of bushings in the above embodiments can be manufactured from any low friction plastic, rubber, or metal. In a preferred embodiment, the bushings have low drag torque and chemical resistance. These bushings can be constructed from virgin PTFE or PTFE with additives for wear, pressure, lubricity, static dissipation, and/or temperature.

Figure 12:
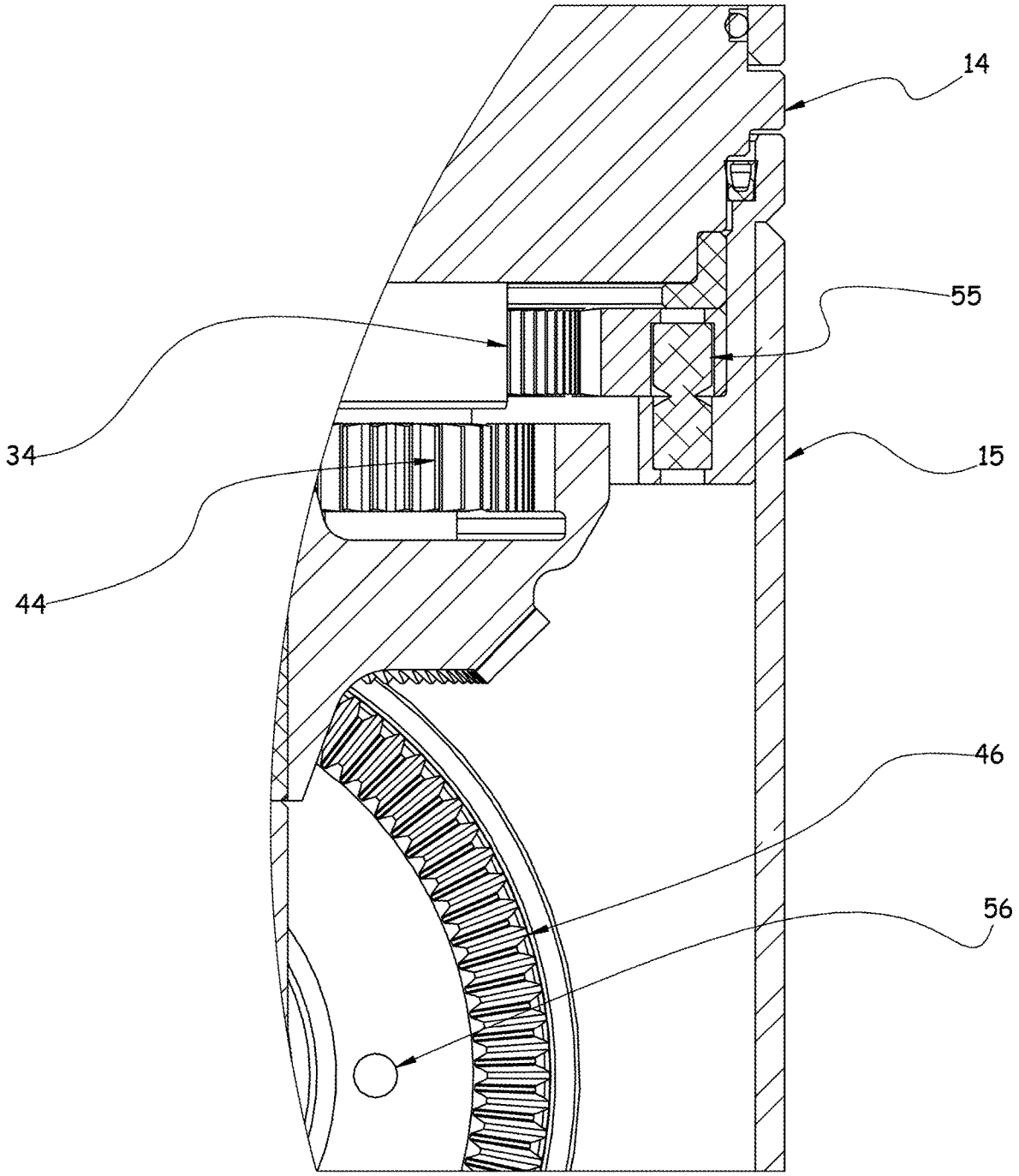
FIG. 12. is an cutaway section of FIG. 4 along arrow 4*x*.

FIG. 12 depicts pan and tilt gear shear pins 55, 56. Each pin will drive the corresponding gear to drive the rotatable lower housing assembly 15 and the rotatable lower housing assembly 16. Each shear pin 55, 56 is comprised of a feature that is engineered to beak at a predetermined force in the event a sudden shock load is encountered; thus, protecting the gear teeth. The pan gear shear pin 55 is tightly fit into the rotatable lower housing assembly 15 and orientated such that a corresponding hole in the pan gear aligns the gear concentrically with the rotatable lower housing assembly 15. The tilt gear shear pin 56 is tightly fit into rotatable fluid jet nozzle assembly 16 and orientated such that a corresponding hole in the tilt gear aligns the gear concentrically with the rotatable fluid jet nozzle assembly 16. In a further embodiment, the gears can be protected from damage by adding a friction clutch between the bevel gear and the fluid jet nozzle assembly. The clutch is comprised of an O-ring 71 sandwiched between the bevel gear and the nozzle hub. The bevel gear drives the nozzle assembly through friction force that can be adjusted by tightening or loosening the nozzle hub securing screws. Properly adjusted, the friction force is set approximately 10 to approximately 100% above the required driving force so that a set breakaway force is achieved. It the nozzle assembly is dropped such that a large back-driving torque is created on the housing, the clutch will slip protecting the gears and internal components from damage. In a further embodiment, the clutch can be spring loaded and may include friction plates. In another embodiment, the clutch could include a spring loaded ball rolling in a groove. One or more detents are incorporated into the nozzle hub such that one the over torque condition is rectified; the ball will land in the detent and drive the nozzle assembly.

The HPU of FIG. 1 can include, but not limited to, the requisite hydraulic pump driven by an electric motor to supply the system with flow and pressure of hydraulic fluid from an integrated storage reservoir. Supply and return hoses connect between the hydraulic power unit and the hydraulic manifold.

Figure 9:
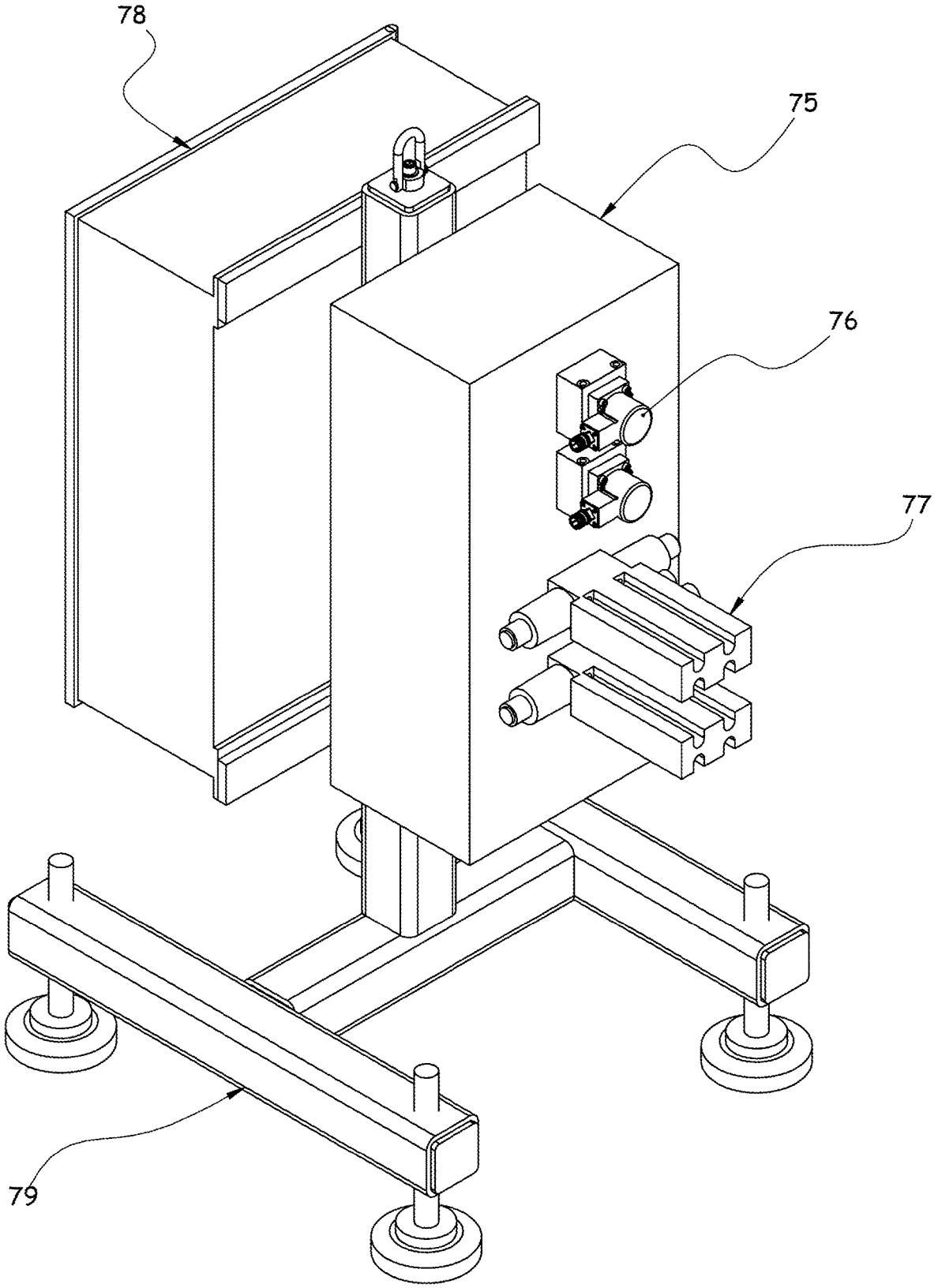
FIG. 9 is perspective view of the hydraulic manifold of FIG. 1.

FIG. 9 is a perspective view of a hydraulic control unit used in the system of FIGS. 1 and 2. The hydraulic control system can include a HPU and manifold block 75 populated with precision servo valves 76 used to control the nozzle assembly 1 of FIG. 1. A preferred embodiment can use servo valve (or proportional servo valve) control signals that can range from 0 to approximately 100 milliamps. In one embodiment, the signal could be up to, but not including, approximately +/−approximately 40 volts. In another embodiment, the control signal could be transmitted over Ethernet, Profibus, DeviceNet, or any other network protocol or fieldbus communication protocol. Other hydraulic circuit components 77 can also be mounted to the manifold. Hydraulic circuit components 77 can include, but not limited to, servo-proportional valves, solenoid valves, pressure relief valves, fittings, accumulator, a manifold block, gauges, filters, or any devices required to control the nozzle assembly 1. The manifold 75 and corresponding electrical panel 78 can be mounted onto a common frame structure 79 and remotely located outside the classified hazardous area.

In another embodiment, the electrical circuits can be connected to intrinsically safe barriers and the electronic components will be rated for use in classified hazardous areas.

Another embodiment of the device can use explosion proof electric motors to manipulate the nozzle assembly. The motors and actuators would be connected by power and signal cables coming from the device within the tank section being cleaned to an electrical motion controller and power supply residing in the control station located outside the classified hazardous area.

In another embodiment, the control station can be equipped with explosion proof or intrinsically safe components allowing operation in a classified hazardous zone where flammable gases or dust may exist.

In another embodiment, the electrical panel 78 can be positively purged and monitored with a safety pressure switch interlocked into the control system. If the enclosure does not see adequate pressure, then the enclosure cannot be energized. Housed in the electrical panel 78, can be a motion controller that sends signals to the servo valves 76 in order to manipulate all axes.

Figure 10:
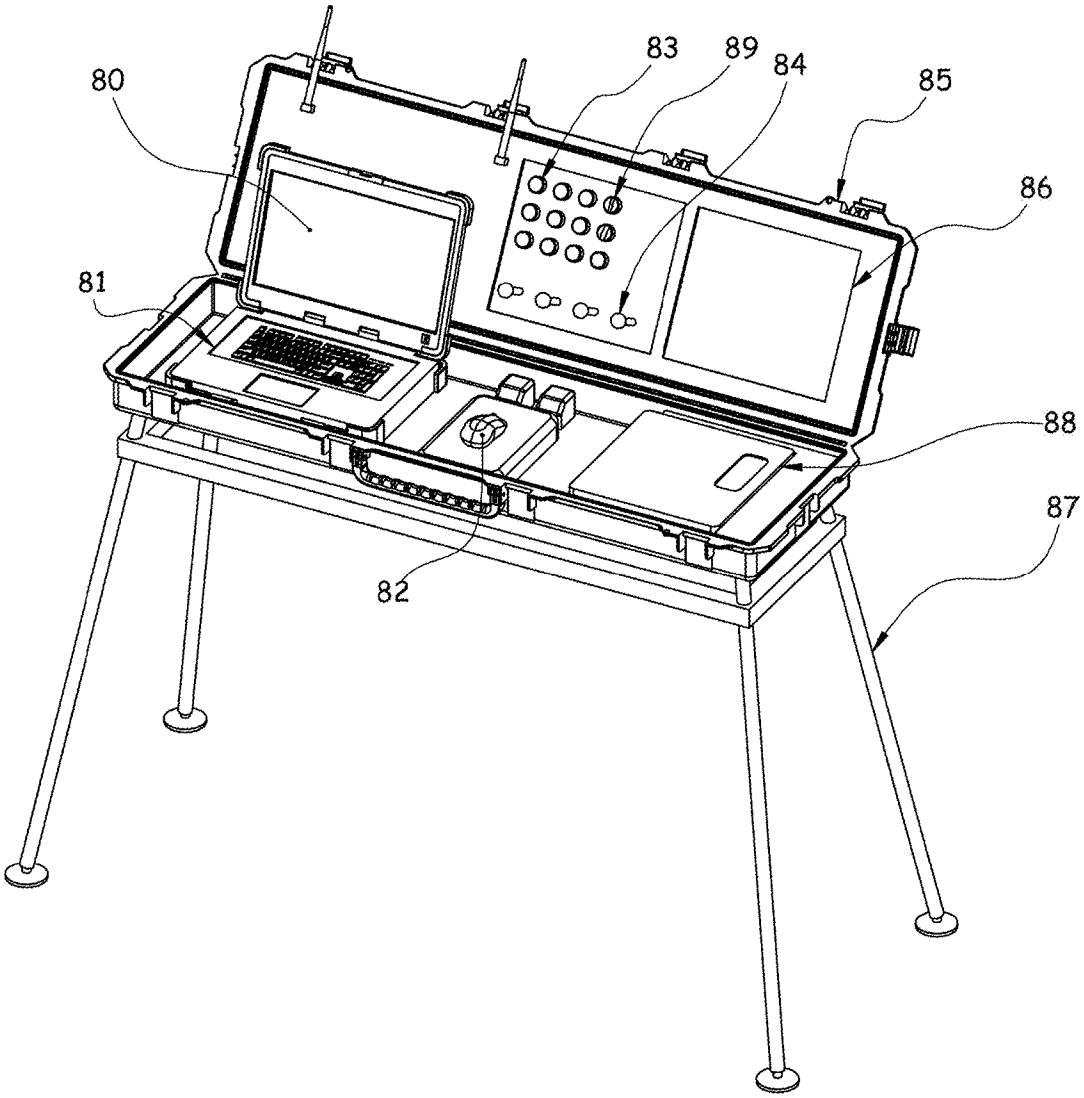
FIG. 10 is perspective view of the control station of FIG. 1.

Referring to FIG. 10, a human machine interface (HMI) comprised of a user screen 80, keyboard 81, mouse 82, central processing unit (CPU) 88, operating system, control software, one or more pushbuttons 83, one or more switches 89, and/or one or more joystick controllers 84 all housed in a portable control station 85. In certain embodiments, a portable stand 87 can be implemented. In one embodiment, multiple screens 86 are incorporated. In one embodiment, a real-time operating system can be used.

Figure 11:
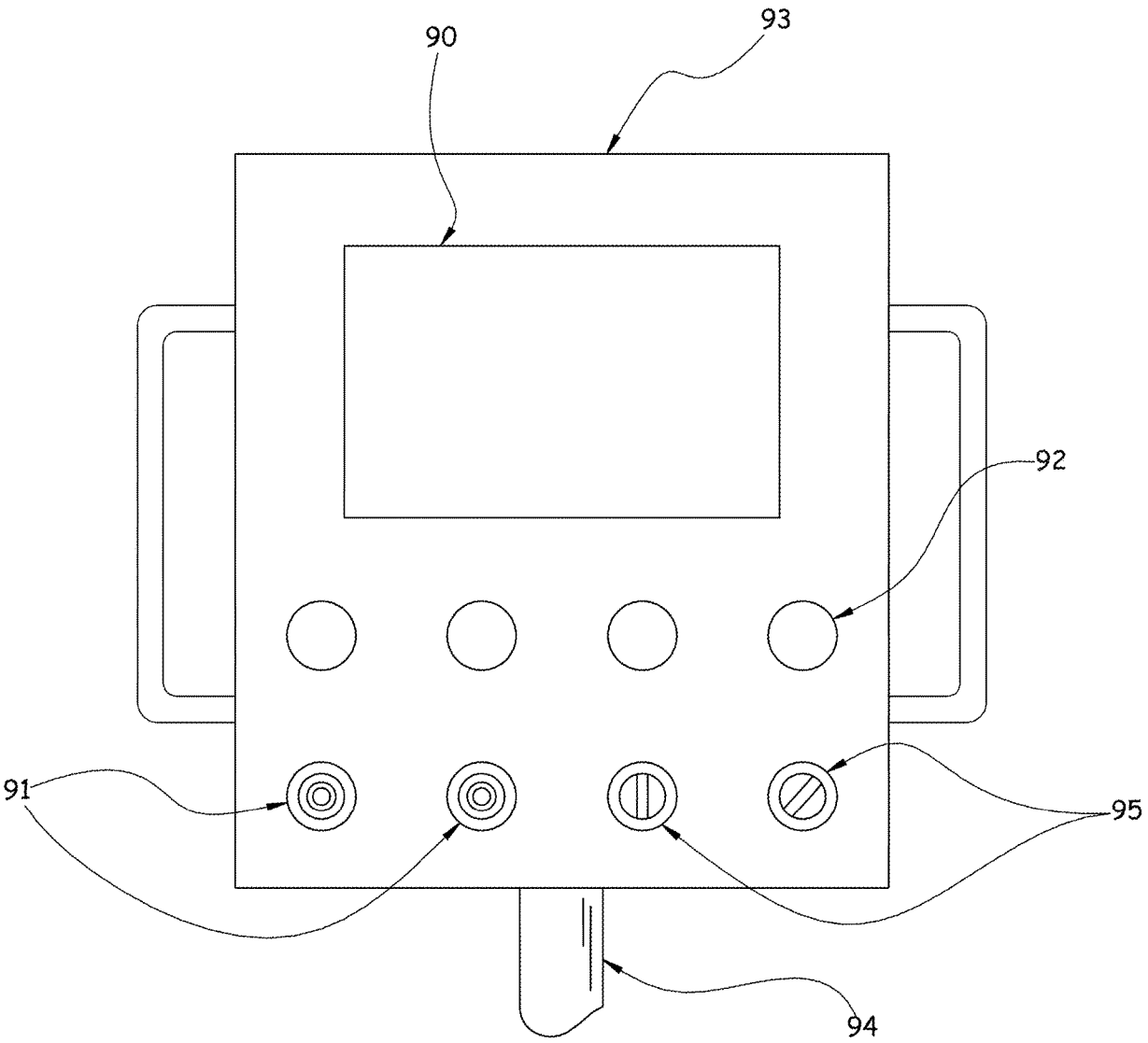
FIG. 11 is an illustration of a handheld remote control of another embodiment.

FIG. 11 shows a handheld remote control where certain embodiments can be used to control the nozzle assembly. The handheld remote control is comprised of a touchscreen 90, one or more pushbuttons 91, one or more switches 95, and/or one or more joystick controllers 92 all housed in a durable, hand held case 93. The handheld remote control is tethered to the control station through a flexible electrical cable 94.

In another embodiment, the handheld remote control can be wireless in which a local router can be tethered to the handheld control station through a flexible electrical cable.

In certain embodiments, the invention can be operated from a handheld remote control up to approximately 1000 feet away.

Creation of recipes for cleaning specific tanks and commodities can be performed through the control software using a visual interface showing tank interiors, features, patterns to be employed, and regions to be cleaned. At the HMI, an operator inputs diameter(s), lengths, widths, heights, waste depths, etc. to configure the tank to the application. Locations of features, pumps, manways, etc. can also be entered. The software also includes predefined tank profiles, features, and toolpaths. The nozzle assembly can then be positioned into this configuration. An operator then selects from predefined recipes based on the desired operation. User inputs, e.g., feed rate, pressure, flow, dwell times, etc., allow these recipes to be modified and saved as new recipes. Once a configuration is finalized, the kinematic algorithms determine the coordinates and angles of each axis to form a motion profile dictating the nozzle's motions. From this data, the control programs compile output commands to the motion controller. In certain embodiments, these profiles can be evaluated and edited at the HMI. In further embodiments, the motion profiles are entered into a simulation model for evaluation.

Referring to the preferred embodiment, the HMI can display the cleaning progress real time based on feedback from the control system. Alternately, an inspection system comprising, a camera, housing, lighting, and protective glass could be integrated into the nozzle assembly. In a further embodiment, the camera includes pan, tilt, and zoom functions. In certain embodiments, the camera can transmit an image to a display over a fiber optic cable allowing operation in an area with hazardous and explosive vapors and dusts.

In certain embodiments, distance measuring can be accomplished through a laser sensor mounted on the nozzle assembly. In other embodiments, the distance sensor could include an IR (infrared radiation) sensor, LiDAR (light detection and ranging), or any other noncontact technique to obtain distance measurements. In certain embodiments, a laser pointer is utilized to pinpoint a location to be measured. A laser pointer can be mounted on the nozzle assembly coordinated with the nozzle's line of sight. This allows tank imaging can be done prior to cleaning as coordinates can be recorded as an operator manipulates the nozzle and selects points with a laser sensor. Repeating as many times as needed. At the user screen, these points can be viewed, edited and linked together to configure the tank and waste contained within and then to establish nozzle paths and time needed based on the amount waste in the tank.

In a further embodiment, 3D mapping of the tank and waste surface(s) can be accomplished through one or more imaging sensors utilizing ToF (time of flight), stereo vision, structured light, or any imaging technology that can be used to develop 3D point clouds. The preferred embodiment can be equipped with the 3D imaging sensors integrated with nozzle assembly such that an operator can maneuver the 3D imaging sensor to an area in order to take a snapshot. This can be done manually using the remote control or HMI. In one embodiment, the sensors can be handheld.

In an alternate embodiment, the sensors can be mounted remotely with a portable mounting structure. In this embodiment, the sensor can be operated independently from the nozzle assembly allowing an operator to scan new areas while the nozzle is cleaning. This increases the efficiency by reducing the overall cycle time. In another embodiment, sensors can be employed in conjunction with remote sensors.

In certain embodiments, scanning can be done real-time as the camera travels through an area. The generated point cloud will show the geometry on the touchscreen or HMI. Multiple point clouds can be linked together without external, dedicated targets. This data is loaded into the control software to be analyzed by 3D CAD software. An operator can edit and finalize the CAD rendering to be used as a predefined profile for use as described above. In other embodiments, the software automatically recognizes standard features from the point cloud and populates that region with a 3D surface. The remaining data is rendered and meshed into the existing 3D surfaces. This routine can be repeated until ended.

Safety features can include devices that are electrically connected to the control system that when activated brings all motion to a safe and controlled stop. The safety devices can include, but not limited to, e-stop buttons, e-stop cables, safety mats, light curtains, or scanning lasers. These devices can be employed in plurality and in any combination thereof.

Certain embodiments can comprise further safety features that incorporate whisker style limit switches to detect interferences between the nozzle assembly and another object. Once a crash is detected, a signal is sent to the controller that brings any motion to a controlled stop. Whisker style limit switches can be, but not limited to, a limit switch actuated by a rod protruding parallel axially to the nozzle assembly body. A plurality of whisker style limit switches can be mounted radially around the nozzle assembly for 360 degrees of detection. Other embodiments can use ultrasonic, laser, infrared (IR), proximity, or 3D scanners.

The Programmable Tank Cleaning Nozzle can be used for, but not limited to, cleaning any oil rig platform ballast tanks, oil field tanks, ship ballast tanks, hazardous waste tanks, rail car tanks, void tanks, floating roof tanks, or any other large storage tanks of various shapes, e.g., cylindrical, rectangular, spherical, etc.

The Programmable Tank Cleaning Nozzle can operate as an independent, standalone unit. In further embodiments, the Programmable Tank Cleaning Nozzle can be integrated into existing control systems though hardwire signals, serial communication such as Ethernet, Profibus, DeviceNet, or any other network protocol or fieldbus communication protocol.

Two or more Programmable Tank Cleaning Nozzles can be deployed in a single tank. Each nozzle can work independently or in concert to clean large, hard to reach areas more efficiently. The nozzles can also be synchronized together to vector a resultant stream at a single point of impingement. Multiple nozzles can create a networks of troughs, or pathways, such that waste can be effectively directed towards and into retrieval pumps. This reduces the use and loss of liquefiers, water or any other fluid used to clean large tanks.

While the preferred embodiment depicts a 2-axes invention, a plurality of axes can be employed in a single nozzle assembly 1 using a combination of any and/or all methods described within previously described embodiments. The degrees of freedom could include pan, tilt, elevate, rotate, azimuth, raise, lower, telescope, pitch, roll, yaw, forward, backward, up, down, or any other freedom of movement in three-dimensional space.

Although specific advantages have been enumerated above, various embodiments may include some, none, or all of the enumerated advantages.

Other technical advantages may become readily apparent to one of ordinary skill in the art after review of the following figures and description.

It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Unless otherwise specifically noted, articles depicted in the drawings are not necessarily drawn to scale.

Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

To aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

The term "approximately" is similar to the term "about" and can be +/−10% of the amount referenced. Additionally, preferred amounts and ranges can include the amounts and ranges referenced without the prefix of being approximately.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A hydraulically controlled, programmable tank cleaning nozzle system, comprising:

a tank cleaning nozzle having one or more degrees of freedom that operates as an independent, standalone unit with a multiple axes motion controller;

a mount for mounting the tank cleaning nozzle to a structure selected from one of any existing: a pipe, a boom, a robotic arm, a gantry system, a rigid beam, a manway, and another rigid structure; and at least one encoder wired to an isolation barrier for providing positional feedback control for the tank cleaning nozzle for operation in hazardous environments.

2. The system of claim 1, further comprising:

controls integrated into the system using at least one of: Ethernet, Profibus, DeviceNet, or any other network protocol or fieldbus communication protocol to interface with third party equipment.

3. The system of claim 1, further comprising:

at least two 2 hydraulically controlled, programmable tank cleaning nozzle systems working in concert.

4. A hydraulically controlled, programmable tank cleaning nozzle system, comprising:

a tank cleaning nozzle having one or more degrees of freedom that operates as an independent, standalone unit with a multiple axes motion controller;

a mount for mounting the tank cleaning nozzle to a structure selected from one of any existing: a pipe, a boom, a robotic arm, a gantry system, a rigid beam, a manway, and another rigid structure; and a hydraulic power unit, and manifold with flow modulating electro-hydraulic valves to control hydraulically actuated motors for operating the system in hazardous and explosive environments.

5. The system of claim 1, further comprising:

a control station with a human machine interface allowing control of the system from up to approximately 1000 feet away from the system.

6. The system of claim 1, wherein the tank cleaning nozzle includes:

a nozzle assembly comprised of one or more low pressure, high flow fluid jet operating a pressure of up to approximately 5000 psig and a flow rate ranging from approximately 10 to approximately 500 GPM.

7. The system of claim 1, wherein the tank cleaning nozzle includes:

a nozzle assembly comprised of one or more high pressure, low flow fluid jet working at a pressure ranging from approximately 5,000 psig to approximately 50,000 psig and a flow rate range from approximately 0 to approximately 50 GPM.

8. The system of claim 1, further comprising:

one or more low pressure, high flow fluid jets integrated with one or more high pressure, low flow fluid jets where the low pressure, high flow fluid jets operates at a pressure of up to approximately 5000 psig and a flow rate ranging from approximately 10 to approximately 500 GPM and a high pressure, low flow fluid jets operating at a pressure range between approximately 5,000 psig to approximately 50,000 psig and a flow rate range from 0 to approximately 50 GPM.

9. A hydraulically controlled, programmable tank cleaning nozzle system, comprising:

a tank cleaning nozzle having one or more degrees of freedom that operates as an independent, standalone unit with a multiple axes motion controller;

a mount for mounting the tank cleaning nozzle to a structure selected from one of any existing: a pipe, a boom, a robotic arm, a gantry system, a rigid beam, a manway, and another rigid structure; and an inspection system that includes a camera housed in a protective case behind protective glass.

10. A hydraulically controlled, programmable tank cleaning nozzle system, comprising:

a tank cleaning nozzle having one or more degrees of freedom that operates as an independent, standalone unit with a multiple axes motion controller;

a mount for mounting the tank cleaning nozzle to a structure selected from one of any existing: a pipe, a boom, a robotic arm, a gantry system, a rigid beam, a manway, and another rigid structure; and a distance measurement system comprising a laser sensor mounted on the nozzle assembly.

11. A hydraulically controlled, programmable tank cleaning nozzle system, comprising:

a tank cleaning nozzle having one or more degrees of freedom that operates as an independent, standalone unit with a multiple axes motion controller;

a mount for mounting the tank cleaning nozzle to a structure selected from one of any existing: a pipe, a boom, a robotic arm, a gantry system, a rigid beam, a manway, and another rigid structure; and an encoder transmitting data over fiber optic cables for operation in hazardous environments.

12. A hydraulically controlled, programmable tank cleaning nozzle system, comprising:

a tank cleaning nozzle having one or more degrees of freedom that operates as an independent, standalone unit with a multiple axes motion controller;

a mount for mounting the tank cleaning nozzle to a structure selected from one of any existing: a pipe, a boom, a robotic arm, a gantry system, a rigid beam, a manway, and another rigid structure; and a plurality of crash detection whisker style limit switches mounted radially around the tank cleaning nozzle.

13. A hydraulically controlled, programmable tank cleaning nozzle system, comprising:

a tank cleaning nozzle having one or more degrees of freedom that operates as an independent, standalone unit with a multiple axes motion controller;

a mount for mounting the tank cleaning nozzle to a structure selected from one of any existing: a pipe, a boom, a robotic arm, a gantry system, a rigid beam, a manway, and another rigid structure; and software that analyzes point cloud data to recognize standard geometry and then populate missing data to yield a complete feature profile.

14. A hydraulically controlled, programmable tank cleaning nozzle system, comprising:

a tank cleaning nozzle having one or more degrees of freedom that operates as an independent, standalone unit with a multiple axes motion controller;

a mount for mounting the tank cleaning nozzle to a structure selected from one of any existing: a pipe, a boom, a robotic arm, a gantry system, a rigid beam, a manway, and another rigid structure; and a 3D sensor that scans the area such that the software renders point cloud data into 3D CAD models.

15. A hydraulically controlled, programmable tank cleaning nozzle system, comprising:

a tank cleaning nozzle having one or more degrees of freedom that operates as an independent, standalone unit with a multiple axes motion controller;

a mount for mounting the tank cleaning nozzle to a structure selected from one of any existing: a pipe, a boom, a robotic arm, a gantry system, a rigid beam, a manway, and another rigid structure; and a homing sensor using fiber optics for use in hazardous environments.

16. A hydraulically controlled, programmable tank cleaning nozzle system, comprising:

a tank cleaning nozzle having one or more degrees of freedom that operates as an independent, standalone unit with a multiple axes motion controller;

a mount for mounting the tank cleaning nozzle to a structure selected from one of any existing: a pipe, a boom, a robotic arm, a gantry system, a rigid beam, a manway, and another rigid structure; and a shear pin on a fluidized jet assembly to protect gears from damage in the event the nozzle assembly is dropped or hit.

17. The system of claim 1, further comprising:

software for user definition of tank details and cleaning parameters selected from at least one of toolpath, speeds and dwell times.

18. The system of claim 1, further comprising:

two opposing fluid jet nozzles, approximately 180 degrees apart, to balance thrust forces.

19. A hydraulically controlled, programmable tank cleaning nozzle system, comprising:

a tank cleaning nozzle having one or more degrees of freedom that operates as an independent, standalone unit with a multiple axes motion controller;

a mount for mounting the tank cleaning nozzle to a structure selected from one of any existing: a pipe, a boom, a robotic arm, a gantry system, a rigid beam, a manway, and another rigid structure; and a pan and tilt axis drive each consisting of a parallel shaft gear train where spur gears have the capability to be added, subtracted, or rearranged to achieve a reduction ratio ranging from approximately 40:1 up to approximately 400:1.

20. The system of claim 1, further comprising:

low drag, through the use of low friction rotary seals for high flow, low pressure up to approximately 5000 psig and high pressure, low flow fluids and low drag bushings formed from low friction plastic.

21. A hydraulically controlled, programmable tank cleaning nozzle system, comprising:

a tank cleaning nozzle having one or more degrees of freedom that operates as an independent, standalone unit with a multiple axes motion controller;

a mount for mounting the tank cleaning nozzle to a structure selected from one of any existing: a pipe, a boom, a robotic arm, a gantry system, a rigid beam, a manway, and another rigid structure; and at least one encoder with an anti-backlash gear for providing positional feedback control for the tank cleaning nozzle for operation in hazardous environments.

* * * * *